US006390601B1

(12) United States Patent
Morita et al.

(10) Patent No.: US 6,390,601 B1
(45) Date of Patent: May 21, 2002

(54) INK TANK, INK JET HEAD CARTRIDGE, AND INK JET RECORDING APPARATUS

(75) Inventors: Osamu Morita, Yokosuka; Hiroshi Koshikawa; Kenji Kitabatake, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/421,258

(22) Filed: Oct. 20, 1999

(30) Foreign Application Priority Data

Oct. 27, 1998 (JP) ..... 10-305532
Oct. 27, 1998 (JP) ..... 10-306139
Oct. 27, 1998 (JP) ..... 10-306144

(51) Int. Cl.[7] ..... B41J 2/175
(52) U.S. Cl. ..... 347/49; 347/87
(58) Field of Search ..... 347/85, 86, 87, 347/49

(56) References Cited

U.S. PATENT DOCUMENTS 5,815,183 A * 9/1998 Sasaki ..... 347/86
5,825,388 A 10/1998 Sasaki ..... 347/86
6,024,442 A 2/2000 Sato et al. ..... 347/85
6,058,984 A * 5/2000 Sato ..... 141/7

FOREIGN PATENT DOCUMENTS

EP 822084 2/1998
EP 829363 3/1998
JP 410044451 * 2/1998 ..... B41J/2/175

* cited by examiner

*Primary Examiner*—Anh T. N. Vo
(74) *Attorney, Agent, or Firm*—Fitzpatrick, Cella, Harper & Scinto

(57) ABSTRACT

An ink tank is to be held detachably on a tank holder provided with a movable lever having a first engaging pawl to engage with a first engagement hole provided for one side wall of the tank holder, and a second engaging pawl to engage with a second engagement hole provided for side wall opposite to the one side wall having the first engagement hole of the tank holder. For this ink tank, the distance S between the outer side face of the base portion of the movable lever of the ink tank and the leading end of the second engaging pawl is set to be larger than the distance between the inner wall faces of the side wall having the first engagement hole of the tank holder and the side wall having the second engagement hole. With the structure thus arranged, unless the ink tank is kept in the normal posture, the ink tank is not allowed to enter the tank holder, hence enabling the user to recognize it easily and prompt him to operate the installation of the ink tank correctly.

14 Claims, 19 Drawing Sheets

INK TANK, INK JET HEAD CARTRIDGE, AND INK JET RECORDING APPARATUS

BACKGROUND OF THE INVENTION

1. Field of the Invention

The present invention relates to an ink tank and a tank holder that detachably holds the ink tank, as well as an ink jet head cartridge provided with the tank holder and an ink jet head that performs recording by discharging ink. The invention also relates to an ink jet recording head provided with the ink jet head cartridge.

2. Related Background Art

For the ink jet recording apparatus that records by discharging ink, it is known to arrange the structure so that the recording head that discharges ink and the ink tank that supplies ink to the recording head are formed integrally as an ink jet head cartridge which is separable as one unit from the recording apparatus main body, and at the same time, the ink tank is separable from the recording head on the recording apparatus or the head and the ink tank are made separable from each other in a state of being separated from the recording apparatus. For a structure of the kind, it is required to make the recording head and the ink tank easily separable, but ink is supplied to the head reliably when the ink tank is installed on the recording head.

FIGS. 1A and 1B are views which illustrate one example of an ink jet head cartridge having the recording head and ink tank arranged separably. FIG. 1A is a perspective view which shows the tank holder. FIG. 1B is a cross-sectional view thereof. As shown in FIG. 1B, the upper face of the box type tank holder 103 is open in order to hold the ink tank which will be described later. On one side portion of the lower face of the tank holder 103, the ink jet head 102 is arranged. Also, the upper side face of the tank holder 103 is inclined externally as the guide. Then, upper end portion 43 thereof is formed to abut upon the third pawl 133 of the ink tank which will be described later. For the ink jet head 102, the silicon substrate 201 is supported by the base plate 205. On the silicon substrate 201, heaters that serve as electrothermal transducing members are formed to generate thermal energy which is utilized for discharging ink.

Also, for the ink jet head 102, the joint 204 is formed to be connected with the ink supply port of the ink tank when the ink tank is installed on the tank holder 103. For the joint 204, the ink flow paths 206 are formed toward the silicon substrate 201.

FIGS. 2A to 2C are views which illustrate one example of the ink tank 111 to be installed on the tank holder shown in FIGS. 1A and 1B. FIG. 2A is a perspective view which shows the ink tank 111, observed in the direction toward the second pawl 132. FIG. 2B is a perspective view which shows the ink tank 111 observed in the direction toward the movable lever 130. Also, FIG. 2C is a cross-sectional view which shows the ink tank 111.

As shown in FIGS. 2A and 2B, on one side face of the ink tank 111, the movable lever 130 is arranged with the first pawl 131. On the other side face of the ink tank 111, there are arranged the second pawl 132 that engages with the second hole 242 of the tank holder 103, and the third pawl 133 that abuts upon the upper end 142 of the tank holder 103. The first pawl 131 and the second pawl 132 engage with the first hole 241 and the second hole 242 formed on the tank holder 103 (see FIG. 10), respectively, when the ink tank 111 is installed on the tank holder 103. In this manner, the ink tank 111 is fixed to the tank holder 103. On the lower face of the ink tank 111, the ink supply port 211 is arranged to protrude from that face cylindrically.

Also, as shown in FIG. 2C, in the interior of the ink tank 111, the ink absorbent 136 is housed to retain ink by the absorption of ink which is liquid. In the interior of the ink supply port 221, the joint member 154 is filled to be joined with the ink absorbent 136. When the ink tank 111 is installed on the tank holder 103, ink retained in the ink absolvent 136 is supplied to the ink jet head 102 from the ink supply port 211 through the joint member 154.

FIGS. 3A to 3D are views which illustrate the procedures to install the ink tank on the tank holder 103.

At first, as shown in FIG. 3A, the face of the ink tank 111 on the ink supply port 211 side is directed to the upper surface of the tank holder 103. At the same time, the second pawl 132 of the ink tank 111 is inclined downward. Then, the ink tank is being inserted into the interior of the tank holder 103.

At this juncture, if the ink tank 111 is installed in the diagonal direction as shown in FIG. 3B, the third pawl 133 abuts upon the upper end 143 of the tank holder 103 before the outer circumference of the ink supply port 211 abuts upon the joint member 204 of the head cartridge. Thus, the outer circumference of the ink supply port 211 is prevented from being in contact with the joint member 204. In this manner, the normal setting operation is promoted.

Then, as shown in FIG. 3C, the ink tank is inserted along the inclined face of the tank holder 103 on its side indicated on the right-hand side in FIG. 3C. Here, the second pawl 132 of the ink tank 111 is at first engages with the second hole 242 of the tank holder 103.

Further, as shown in FIG. 3D, the ink tank 111 is pressed into the tank holder 103 so that the movable lever 130 is bent to the inner side to enable the first pawl 131 to engage with the first hold 241 of the tank holder 103. Thus, the ink tank 111 is fixed to the thank holder 103. Also, the third pawl 133 is set in the inner side of the tank holder 103 which is inclined to the outer side.

In this state, ink retained in the ink absorbent 136 is introduced into the ink jet head 202 through the joint member 137 of the ink supply port 211. Then, by the application of energy generated by the electrothermal transducing devices (not shown), ink is discharged from the discharge ports (not shown).

In this respect, when the ink tank 111 is removed, the movable member 130 is bent to the inner side to enable the first pawl 131 to be released from the first hole 241 of the tank holder 103. Then, the ink tank 111 is easily removed from the tank holder 103.

In this way, as shown in FIGS. 1A to 2C, the combination of the ink tank and the recording head provided with the tank holder makes it easier to attach to or detach from each other by the installation method as shown in FIGS. 3A to 3D. Then, ink is reliably supplied to the recording head in the state of the ink tank being installed on the recording head. Now that these requirements are satisfactorily met, this combination is excellent in its practical use.

Nevertheless, as a result of ardent studies of the inventors hereof, it has been found that if the following operations should be carried out, there is a fear that the installation is not made exactly as anticipated, although such installation is not among the operations which are fundamentally expected.

At first, as shown in FIG. 4A, if it is attempted to install the ink tank 111 on the ink holder 103 by holding the ink tank in the horizontal posture and lowering it straightly in such condition. Then, as shown in FIG. 4B, the second pawl 132 is pressed by the side face slightly above the second hole 242 of the tank holder 103, and the first pawl 131 of the movable lever 130 is also caused to stay at the side face slightly above the first hole 241 to make it difficult to press the ink tank 111 any further. As a result, there is a fear that the ink supply port 211 does not join the joint member 204 exactly as anticipated.

Further, even when it becomes difficult to press the ink tank 111 any more as described above, the first pawl 131 of the movable lever 130 still resides in a position slightly above the first hole 241 of the tank holder 103 as shown in FIG. 5. Therefore, if the user presses the ink tank forcefully, the first pawl 131 is allowed to engage with the first hole 241 eventually. As a result, the user may be misled, and commits himself to the wrong recognition as to the installation of the ink tank.

Also, depending on the configuration of a tank holder, the corner portions of the lower face of the ink tank or the leading end of the ink supply port is allowed to slip into the gap in front of the joint when the user intends to install the ink tank by inclining it at a specific angle for the installation on the tank holder. As a result, the installation is not made exactly as anticipated.

Further, as shown in FIG. 1A, if a plurality of ink tanks each having different kind of ink retained in it are arranged to be installed on the tank holder, these erroneous installation also present problems discussed above.

SUMMARY OF THE INVENTION

With a view to solving these technical problems, the present invention is designed. It is an object of the invention to provide an ink tank and an ink jet head cartridge capable of installing the ink tank on the ink jet heat safely without any difficulties in a simple and inexpensive method. The invention is also aimed at the provision of an ink jet recording apparatus provided with such ink jet head cartridge.

In order to achieve these objectives, the ink tank of the present invention is to be held detachably on a tank holder provided with a movable lever having a first engaging pawl to engage with a first engagement hole provided for one side wall of the tank holder, and a second engaging pawl to engage with a second engagement hole provided for side wall opposite to the one side wall having the first engagement hole of the tank holder. For this ink tank, the distance S between the outer side face of the base portion of the movable lever of the ink tank and the leading end of the second engaging pawl is set to be larger than the distance between the inner wall faces of the side wall having the first engagement hole of the tank holder and the side wall having the second engagement hole.

Also, an ink jet head cartridge of the present invention comprises an ink tank to retain ink; an ink tank holder to hold the ink tank detachably, having a joint connected with the ink supply port of the ink tank, a first hole to engage with a first pawl of the ink tank, and a second hole to engage with a second pawl of the ink tank on the side face opposite to the side having the first hole; and a recording head unit for discharging ink supplied from the ink supply port. For this ink jet head cartridge, the distance S between the outer side face of the base portion of the movable lever of the ink tank and the leading end of the second engaging pawl is set to be larger than the distance between the inner wall faces of the side wall having the first engagement hole of the tank holder and the side wall having the second engagement hole.

With the structure arranged as described above, it is possible to set the distance S between the outer side face of the base portion of the movable lever of the ink tank and the leading end of the second engaging pawl larger than the distance between the inner wall faces of the side wall having the first engagement hole of the tank holder and the side wall having the second engagement hole. Consequently, unless the normal operation of an installation is carried out, the ink tank is not allowed to enter the tank holder. In other words, if the ink tank is kept in the horizontal posture, and lowered straightly downward as it is for its installation on the tank holder, the second engaging pawl of the ink tank is blocked considerably above the second hole of the tank holder. The first engaging pawl of the movable lever is also blocked on the outer side of the tank holder considerably above the first engagement hole of the tank holder. As a result, it becomes impossible to press in the ink tank any further. In this way, the user can recognize that the ink tank is not installed on the tank holder exactly.

Also, in accordance with another embodiment of the present invention, an ink tank to be held detachably on a tank holder provided with a movable lever having a first engaging pawl to engage with a first engagement hole provided for one side face of the tank holder, and a second engaging pawl to engage with a second engagement hole provided for the other side face of the tank holder opposite to the one side face having the first engagement hole of the tank holder. For this ink tank, the second engaging pawl is configured to be fitted into the second engagement hole only when the ink tank is in a position to be installed on the tank holder.

Also, in accordance with another embodiment of the present invention an ink jet head cartridge comprises an ink tank to retain ink; an ink tank holder to hold the ink tank detachably, having a joint connected with the ink supply port of the ink tank, a first hole to engage with a first pawl of the ink tank, and a second hole to engage with a second pawl of the ink tank on the side face opposite to the side having the first hole; and a recording head unit for discharging ink supplied from the ink supply port. For this ink jet head cartridge, the second engagement hold is configured to be fitted for the second engaging pawl only when the ink tank is in a position to be installed on the tank holder.

With the structure arranged as described above, unless the ink tank is installed on the correct location of the tank holder, the second engaging pawl of the ink tank and the second engagement hole of the tank holder are not allowed to be fitted to each other. Thus, recognizing the wrong installation of the ink tank, the user is prompted to operate the installation again.

In this case, since the third engaging pawl is arranged further above the second engaging pawl, it is possible to know the fitting condition of the ink tank and the ink tank holder before the engagement of the second engaging pawl. Thus, the prevention of the wrong insertion is doubly made by the presence of the third engaging pawl in combination with the second engaging pawl.

In accordance with still another embodiment of the present invention, an ink jet head cartridge comprises an ink tank to retain ink; an ink tank holder to hold the ink tank detachably, having a joint connected with the ink supply port of the ink tank, a first hole to engage with a first pawl of the ink tank, and a second hole to engage with a second pawl of the ink tank on the side face opposite to the side having the first hole; and a recording head unit for discharging ink supplied from the ink supply port. For this ink jet head cartridge, a semicircular rib having a bow-shaped curving face intersecting the inserting direction of the ink tank is arranged on the circumference of the joint of the tank holder for guiding the ink supply port of the ink tank, and a linear rib is arranged to be coupled with the semicircular rib on the side opposite to the joint.

With the structure as described above, it becomes possible to produce an effect that the user can easily install the ink tank on the tank holder with a simple method which is made available at lower costs.

Also, an ink jet recording apparatus of the present invention is provided with a carriage having detachably on it an ink jet head cartridge referred to in the preceding paragraphs, which is supported to be able to reciprocate along the surface of a recording medium, and discharge ink from the recording head unit of the ink jet head cartridge to the recording medium for recording in accordance with electric signals for the ink discharges.

Further, an ink supply system of the present invention comprises a first ink tank to retain first ink; a first ink tank holder to install the first ink tank; a second ink tank to retain second ink; and a second ink tank holder to install the second ink tank. Then, for the first ink tank of this ink supply system, a first pawl extrusion is provided to engage with a first engagement hole of the first ink holder, and a second pawl extrusion is provided to engage with a second engagement hole of the second ink holder, and the first pawl extrusion is the two extrusions arranged in parallel, and given the width of each extrusion as La, the gap between extrusions as Lc, the opening width of the first engagement hole for the first pawl extrusion as Ma, and the gap between openings as Mc, and the second pawl extrusion being one elongated side extrusion and given as Le, and the opening width of the second engagement hole for the second pawl extrusion as Me, the relationship between the first pawl extrusion of the first ink tank and the second engagement hole of the second ink tank holer is to satisfy $Lc+2La>Me$ and/or $Lc>Me$ and the relationship between the second pawl extrusion of the second ink tank and the first engagement hole of the first ink tank holder is to satisfy $Le>Ma$ and/or $Le<Mc$.

Further, an ink tank of the present invention used for an ink jet recording apparatus detachably mounting thereon a recording head for discharging first ink, a first holder provided with two first engagement holes arranged in parallel to be able to install a first ink tank retaining first ink in a width Ma and a gap Mc, and a second holder provided with a second engagement hole to be able to install a second ink tank retaining second ink in a width Me, wherein two pawl extrusions are arranged for said ink tank in a width La with a gap Lc to satisfy the relationship of $Lc+2La>Me$ and/or $Lc>Me$.

Further, an ink tank of the present invention used for an ink jet recording apparatus detachably mounting thereon a recording head for discharging first ink, a first holder provided with two first engagement holes arranged in parallel to be able to install a first ink tank retaining first ink in a width Ma and a gap Mc, and a second holder provided with a second engagement hole to be able to install a second ink tank retaining second ink in a width Me, wherein one pawl extrusion is arranged for said ink tank in a width Le to satisfy the relationship of $Le>Ma$ and/or $Le<Mc$.

Other objectives and advantages besides those discussed above will be apparent to those skilled in the art from the description of a preferred embodiment of the invention which follows. In the description, reference is made to accompanying drawings, which form a part hereof. Such example, however, is not exhaustive of the various embodiments of the invention, and therefore reference is made to the claims which follow the description for determining the scope of the invention.

BRIEF DESCRIPTION OF THE DRAWINGS

FIG. 1A is a perspective view, and FIG. 1B is a cross-sectional view;

DETAILED DESCRIPTION OF THE PREFERRED EMBODIMENTS

Hereinafter, with reference to the accompanying drawings, the description will be made of the embodiments in accordance with the present invention In this respect, the so-called ink having colorants contained in it, which is retained in the ink tank, is exemplified for the description of the embodiments. However, the liquid retained in the ink tank of the present invention is not necessarily limited to ink. All the liquids that can be discharged from the recording head are included. To be more specific, there may be included the processing liquid or the like which enhances the waterproof capability on a recording medium when reacted to other liquid (or ink) on the paper sheet or other recording medium or during the liquid discharge. Now, therefore, in the specification hereof, the term "ink" is used collectively for the liquids that can be discharged from the recording head, such the processing liquids described above.

First Embodiment

Figure 6:
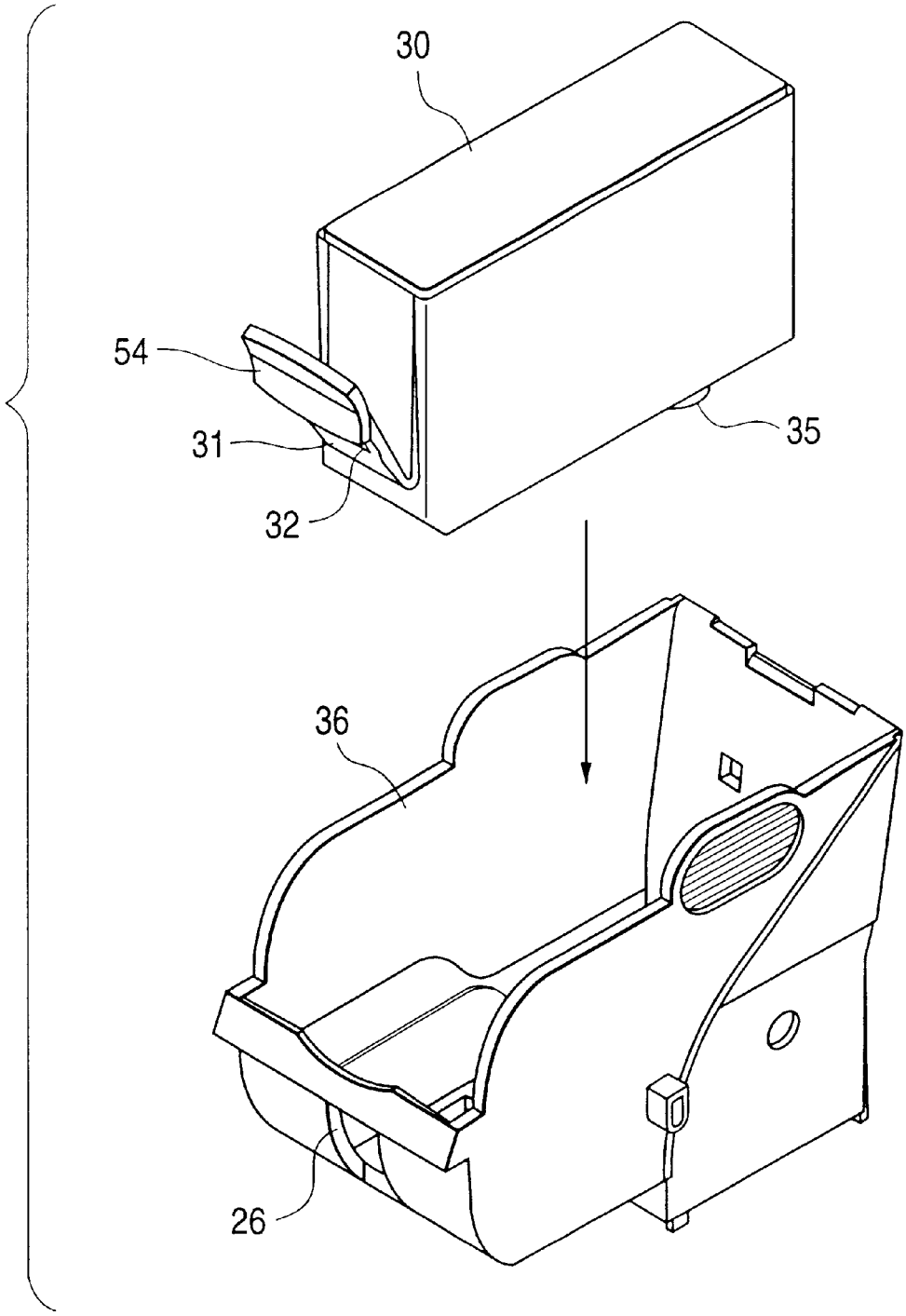
FIG. 6 is a perspective view which illustrate the front side of the ink tank and the tank holder that constitute the ink jet head cartridge for black use in accordance with a first embodiment of the present invention.
Figure 7:
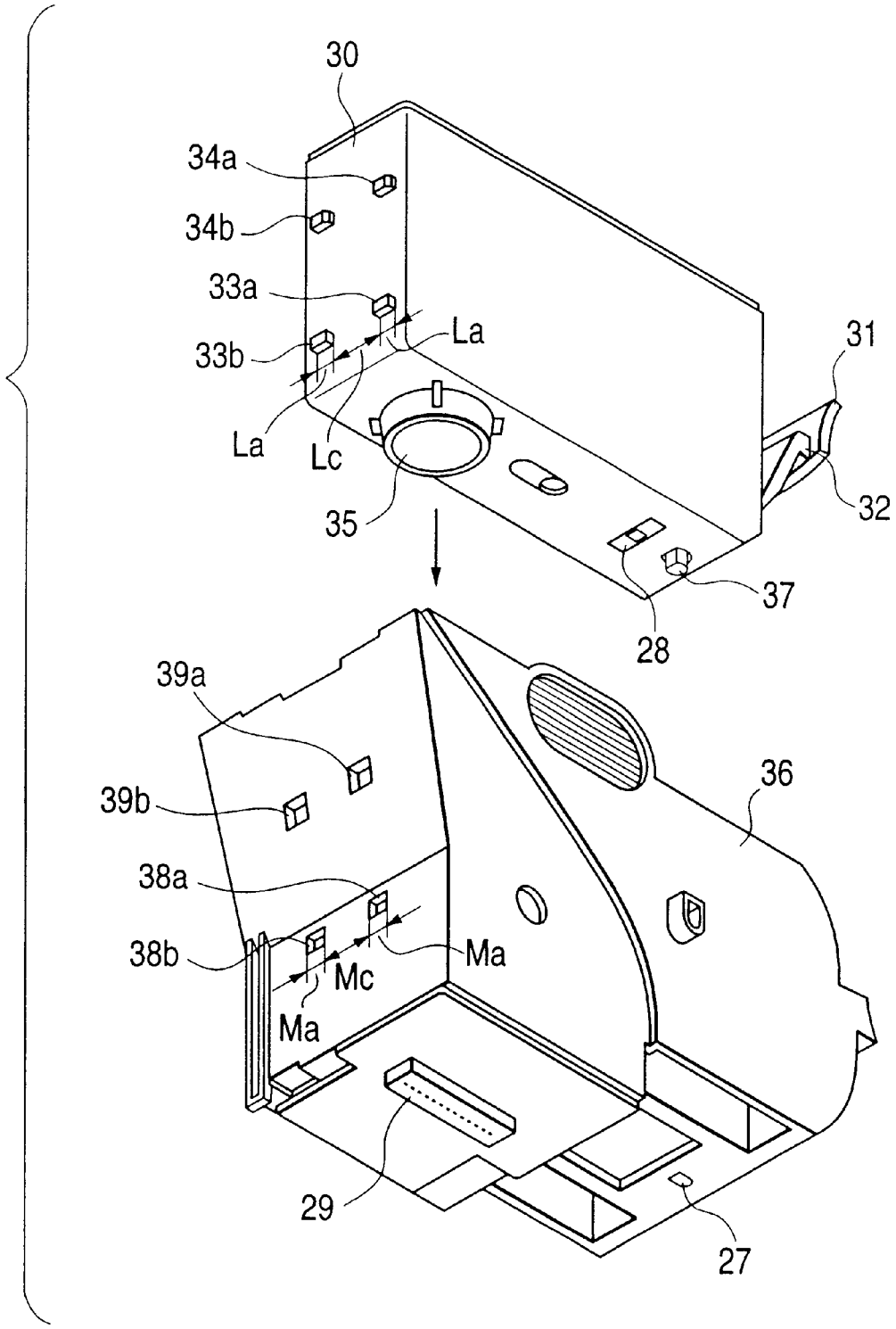
FIG. 7 is a perspective view which illustrate the back side of the ink tank and the tank holder that constitute the ink jet head cartridge for black use in accordance with the first embodiment of the present invention.

FIG. 6 is a view of the head cartridge for black use in accordance with a first embodiment of the present invention, which is observed from the diagonally upper right front side. FIG. 7 is a view of the head cartridge for black use, which is observed from the diagonally lower left back side.

The head cartridge for black use of the present embodiment, which is shown in FIG. 6 and FIG. 7, is structured with a large capacity ink tank 30 for use of black ink, and the tank holder 36 for black use which is provided with the ink jet head 29, and arranged to detachably hold the ink tank 30. On one side face of the ink tank 30, the movable lever 31 is arranged together with the nip 54 and the first pawl 32. On the other side face of the ink tank 30, the second pawls 33*a* and 33*b* are provided. Further, above the second pawls 33*a* and 33*b* on the other side face of this ink tank 30, the third pawls 34*a* and 34*b* are provided.

On the lower part of the ink tank 30, there are provided the ink supply port 35 which cylindrically protrudes from the bottom face of the tank; the position pin 37 used when the ink tank 30 is installed on the tank holder 36; and the prism 28 used for detecting the ink remainders in the tank.

Also, for the tank holder 36, the first hole 26 and the second holes 38*a* and 38*b* are formed with which the first pawl 32 and the second pawls 33*a* and 33*b* engage, respectively, when the ink tank 30 is installed on the tank holder 36. Further, for the tank holder 36, the third holes 39*a* and 39*b* are formed where the third pawls 34*a* and 34*b* are allowed to fall into them once, respectively, for positioning during the installation process of the ink tank 30 on the tank holder 36. Further, on the lower part of the tank holder 36, the positioning hole 27 is arranged to enable the positioning pin 37 of the ink tank 30 to be fitted.

Figure 8A:
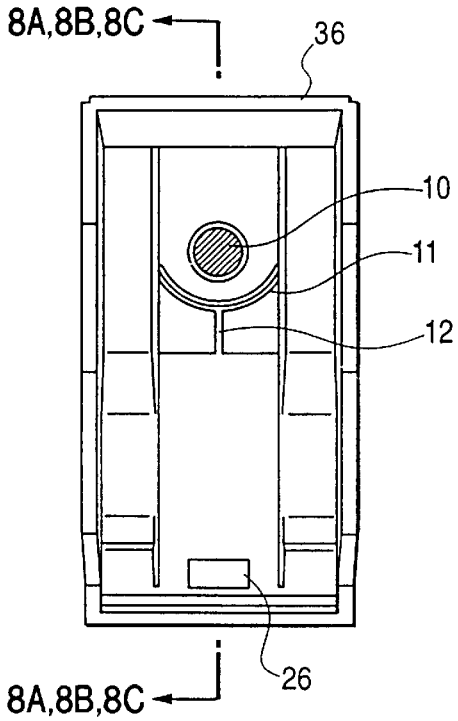
FIG. 8A is a top view which shows the tank holder in accordance with the first embodiment of the present invention.
Figure 8B:
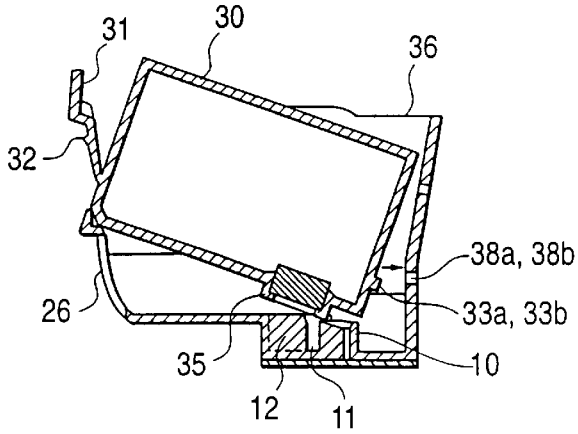
FIGS. 8B, 8C and 8D are cross-sectional views which schematically illustrate the effect of the tank holder.
Figure 8C:
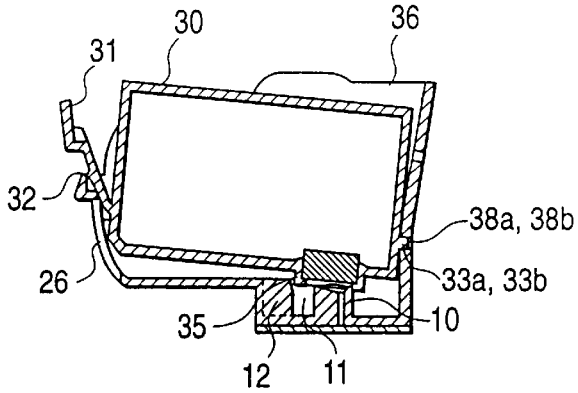
Figure 8D:
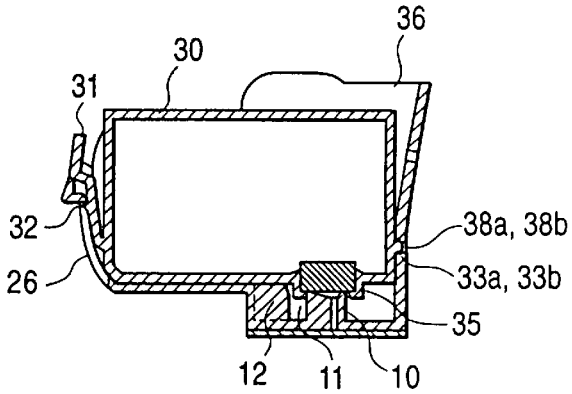

FIG. 8A is the top view of the tank holder. For the tank holder 36, there is further arranged the joint 10 for use of ink supply, which is coupled with the ink supply port 35 of the ink tank 30. Then, in the vicinity of the region on the first hole 26 side, the semicircular rib 11 is arranged as the guide rib provided with the bow-shaped curve which is directed to intersect the insertion of the tank, and also, the linear rib 12 is arranged to be positioned on the side opposite to the joint that engages with the convex portion of the semicircular rib. With the provision of the semicircular rib 11 and the linear rib 12, the leading end of the ink supply port 35 of the ink tank 30 abuts upon the leading end of the linear rib 12 of the tank holder 36 as show in FIG. 8B which is the section taken along line A—A in FIG. 8A even if the ink tank 30 is inserted into the tank holder 36 with an extreme inclination. Then, the ink tank moves in the direction indicated by an arrow so that the ink supply port 36 moves toward the semicircular rib 11. In this manner, only the end portion of the ink supply port of the ink tank abuts on the linear rib 12 and the semicircular rib 11. Consequently, there is no possibility that the leading end of the tank and the end portion of the ink supply port are allowed to slip into the gap in front of the joint of the tank holder, thus causing an inappropriate installation to occur. Thereafter, as shown in FIG. 8C, the ink tank 30 abuts upon the side face of the tank holder 36 on the right side. Then, as shown in FIG. 8D, the ink tank 30 is fixed to the tank holder 36. In this state, the ink supply port 35 is coupled with the joint 10 reliably. As clear from FIGS. 8B to 8D, the effect that may be produced only by the provision of the semicircular rib and the linear rib is not directed related to the presence or absence of the third pawl.

Here, in accordance with the present embodiment, the movable lever and the engaging pawl (the second pawl) are formed integrally with the tank main body by means of molding. For the mold formation material, polypropylene is adopted, because it has excellent ink resistance, gas-barrier capability, and transparency, and also, it is inexpensive.

Now, in conjunction with FIGS. 9A to 9D, the description will be made of the installation (setting) procedures of the ink tank on the tank holder of the ink jet head cartridge further in detail.

Figure 9A:
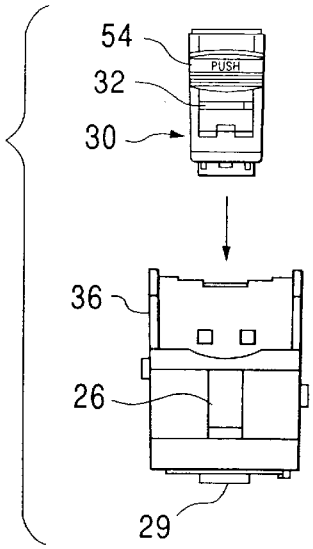
FIGS. 9A, 9B, 9C, 9D, 9E and 9F are views which illustrate the state in which the ink tank is being installed on the tank holder for the ink jet head cartridge for black use in accordance with the first embodiment of the present invention.
Figure 9B:
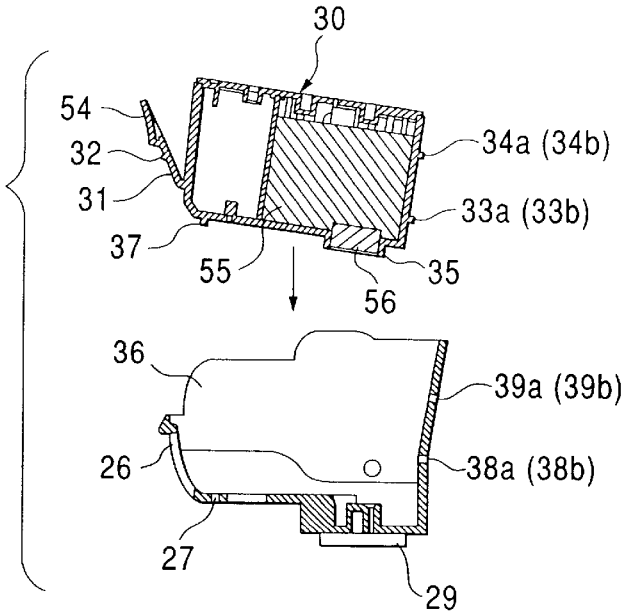

At first, as shown in FIGS. 9A and 9B, the user directs the face of the ink tank 30 on the ink supply port 35 side toward the upper surface of the tank holder 36. At the same time, he places the second pawls 33*a* and 33*b* of the ink tank 30 to be inclined downward, and begins to insert the ink tank 30 into the interior of the tank holder 36.

Figure 9C:
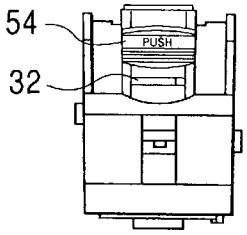
Figure 9D:
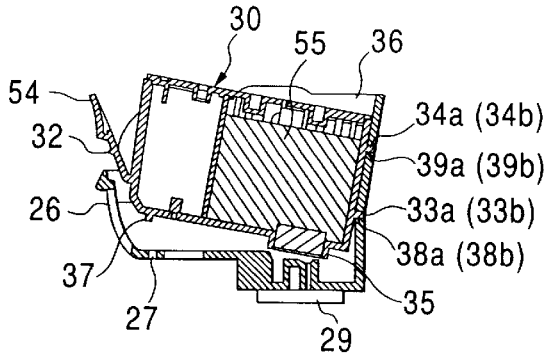

Then, as shown in FIGS. 9C and 9D, the ink tank 30 is inserted along the inclined surface of the tank holder 36 on the right side face in FIGS. 9C and 9D to enable the third pawls 34*a* and 34*b* of the ink tank 30 to engage with the third holes 39*a* and 39*b* of the tank holder 36, and the second pawls 33*a* and 33*b* of the ink tank 30 with the second holes 38*a* and 38*b* of the tank holder 36. In this case, the engagement between the third holes 39*a* and 39*b* and the third pawls 34*a* and 34*b* is made to perform the function of the guide required to operate the rotation of the ink tank 30 exactly later with the positions of the second holes 38*a* and 38*b* as the fulcrum thereof.

Figure 9E:
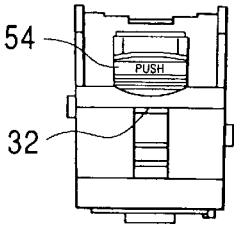
Figure 9F:
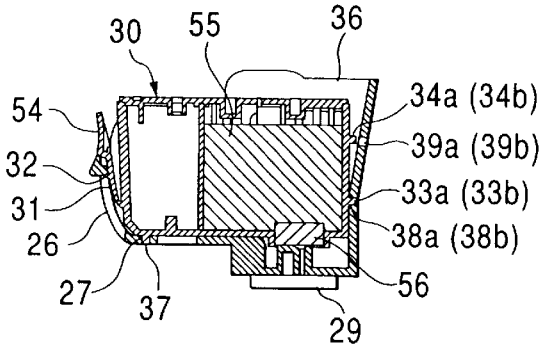

After that, with the second pawls 33*a* and 33*b* which have engaged with the second holes 38*a* and 38*b* of the tank holder 36 as the fulcrum, ink tank 30 is being rotated, and the ink tank 30 is pressed into the tank holder 36. In this manner, as shown in FIGS. 9E and 9F, the movable lever 31 is bent inward. Then, at the same time that the first pawl 32 engages with the first hold 26 of the tank holder 36, the positioning pin 37 of the ink tank 30 is fitted into the positioning hole 27 of the tank holder 36. Hence, the ink tank 30 is fixed to the tank holder 36 in good precision.

In this state, ink retained in the ink absorbent 55 is introduced to the ink jet head 29 through the joint member 56 of the ink supply port 35, and discharged from the discharge ports (not shown) by the application of energy generated by the electrothermal transducing devices (not shown) in the head 29, In this respect, when the ink tank 30 is removed, the movable lever 31 is bent inward to withdraw the first pawl 32 from the first hole 26 of the tank holder 36. Then, the nip 54 of the movable lever 11 is pulled up to remove the ink tank 30 from the tank holder 36 easily.

Here, the positioning pin 37 is positioned in the vicinity of the prism 28. The positioning pin is arranged, in particular, in order to locate the prism 28 between the positioning pin 37 and the second pawls 33*a* and 33*b*, which become the engagement fulcrum at the time of the ink tank installation. In this way, it becomes possible to enhance the portioning precision of the direction of the horizontal rotation of the prism 28 (in the vertical direction on the surface of FIG. 6 and FIG. 7 to be described later) centering on the second holes 33*a* and 33*b*.

Also, the plane of the positioning pin 37 on the second pawls 33*a* and 33*b* side is made to be an abutting portion. In this manner, the plane portion is provided for the side face of the positioning hole 27 of the holder 36 so that the abutting portion of the positioning pin 37 is received by the surface or line, but not just a point. With this arrangement, the positioning precision of the ink tank is enhanced still more. Here, with the combination of each structure including the semicircular rib and the linear rib, a higher effect is produced with respect to the enhancement of the positioning precision in which the ink tank of the kind is installed on the tank holder.

Now, in conjunction with FIGS. 10A and 10B, the description will be made of the structure that prevents the ink tank from being erroneously installed on the tank holder of a head cartridge.

Figure 10A:
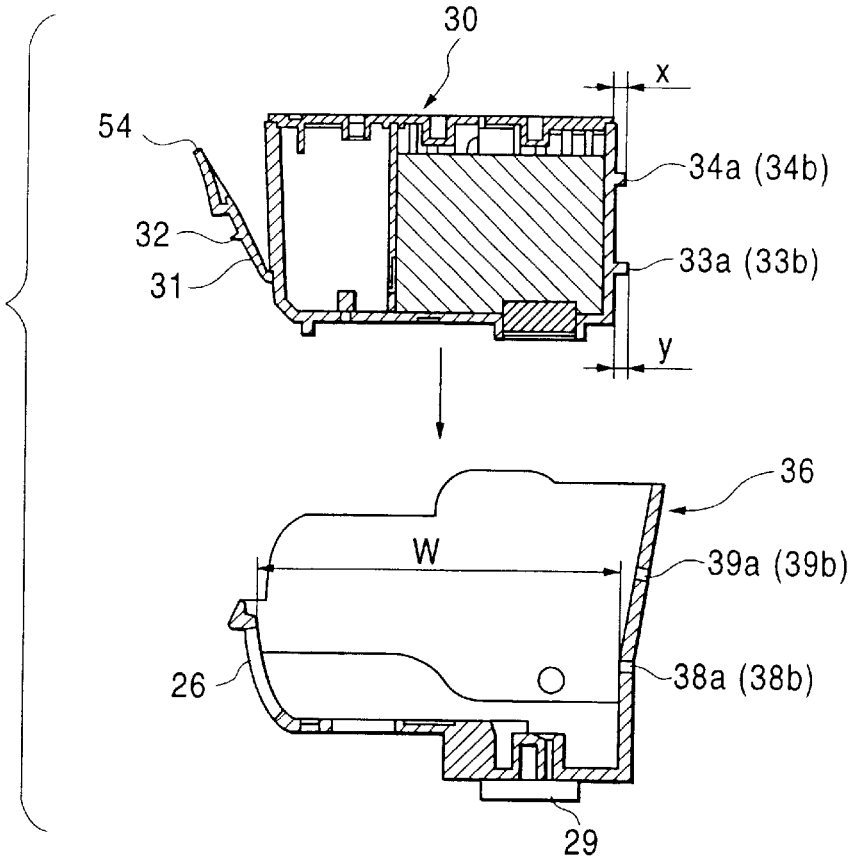
FIGS. 10A and 10B are views which illustrate the case where the ink tank shown in FIG. 6 is held in the horizontal posture, and installed on the tank holder shown in FIG. 6 by lowering it straightly in such posture.

FIGS. 10A is a cross-sectional view which shows the case where the large capacity ink tank 30 for black use shown in FIG. 6 is held in the horizontal posture, and installed on the tank holder 36 by lowering it straightly in such posture. FIG. 10B is a cross-sectional view which shows the state where the ink tank kept in the posture shown in FIG. 10A is installed on the tank holder.

As shown in FIG. 10A, the distance is defined as W between the side wall of the tank holder 36 where the first hole 38 is arranged to engage with the first pawl 32 of the movable lever 31 provided for the one side face of the ink tank 30, and the side wall of the tank holder 36 on which the second hole 38*a* (38*b*) is arranged to engage with the second pawl 33*a* (33*b*) on the side face opposite to the side face where the movable lever of the ink tank 30 is provided.

Figure 10B:
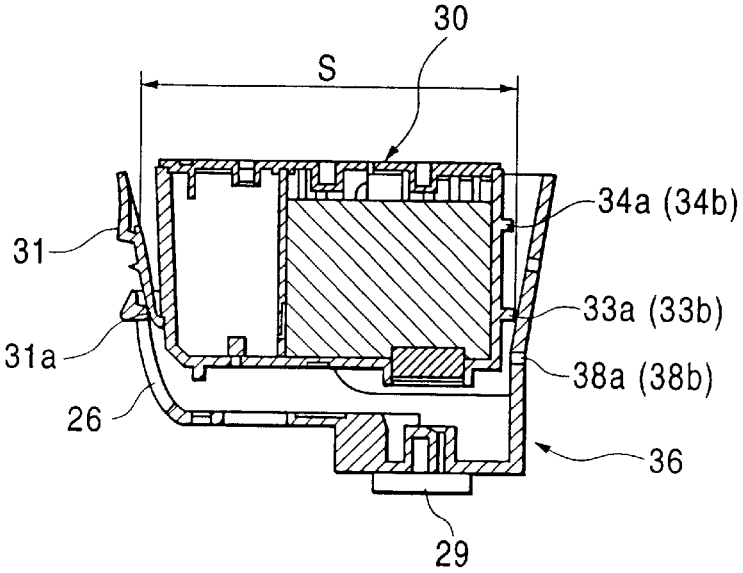

Further, as shown in FIG. 10B, the distance is defined as S between the outer side face of the base 31*a* which becomes the bending point of the warping of the movable lever 31 arranged on one side face of the ink tank 30, and the leading end of the second pawl 33*a* (33*b*) on the side face opposite to the side where the movable lever 31 of the ink tank 30 is provided.

Then, the distance S for the ink tank 30 is set greater than the distance W for the tank holder 36.

In accordance with the present embodiment, the following dimensional values are adopted:

S=72.0±0.1 mm, W=71.4±0.1 mm

Figure 1A:
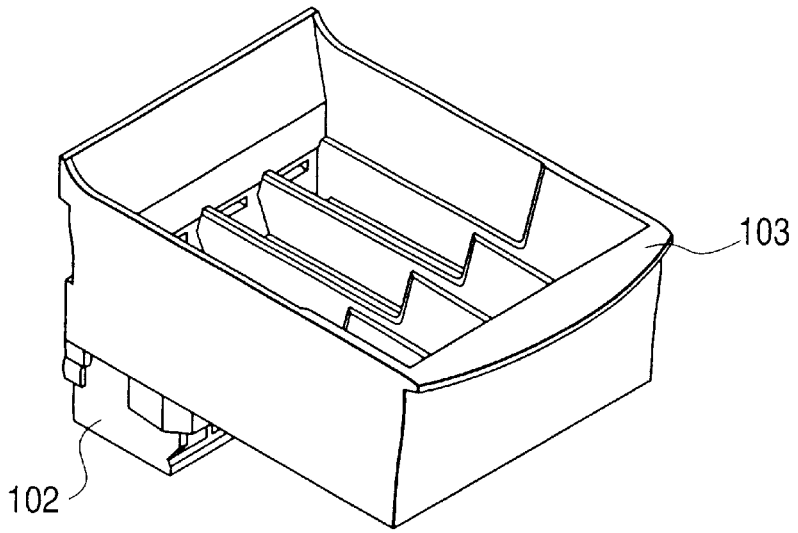
FIGS. 1A and 1B are views which illustrate one example of the conventional tank holder.
Figure 1B:
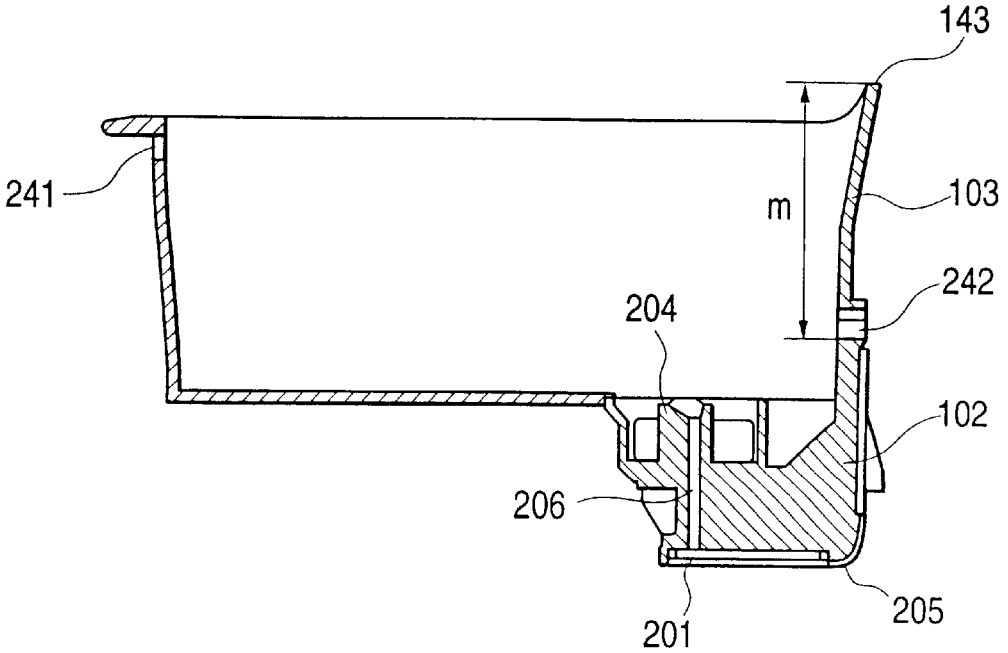
Figure 2A:
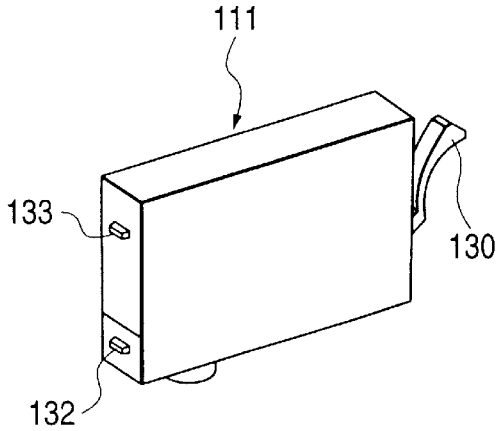
FIGS. 2A, 2B and 2C are views which illustrate one example of the ink tank installed on the tank holder shown in FIGS. 1A and 1B.
Figure 2B:
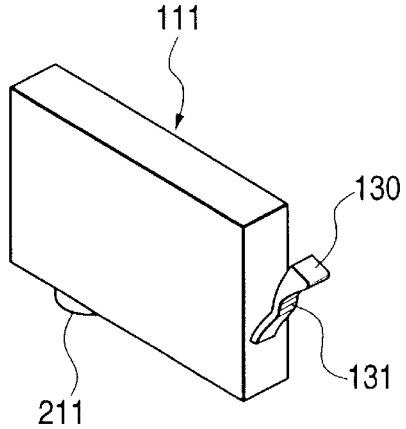
Figure 2C:
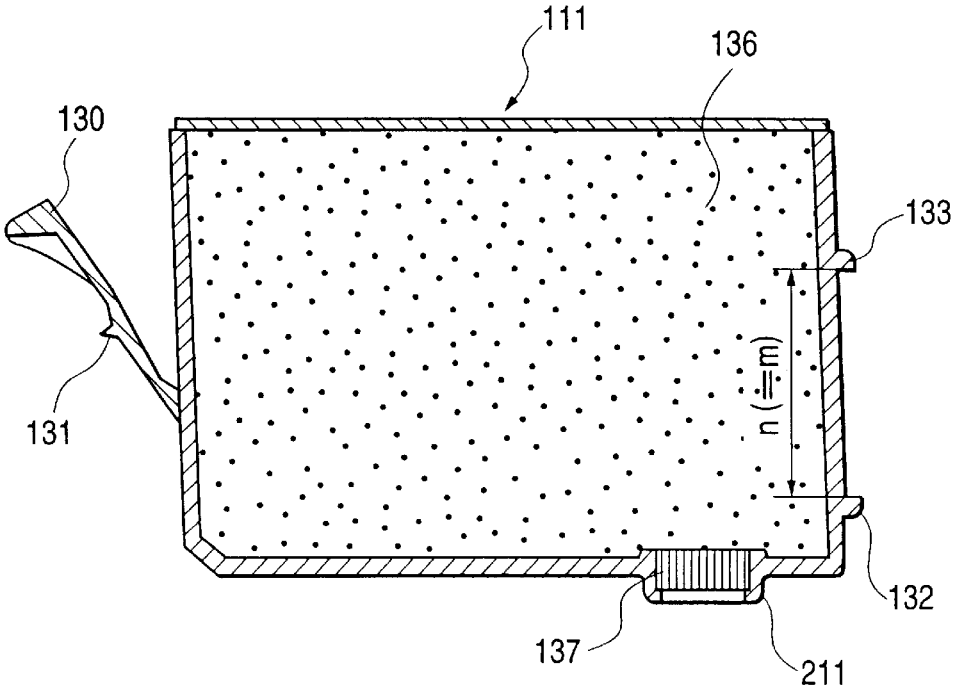
Figure 3B:
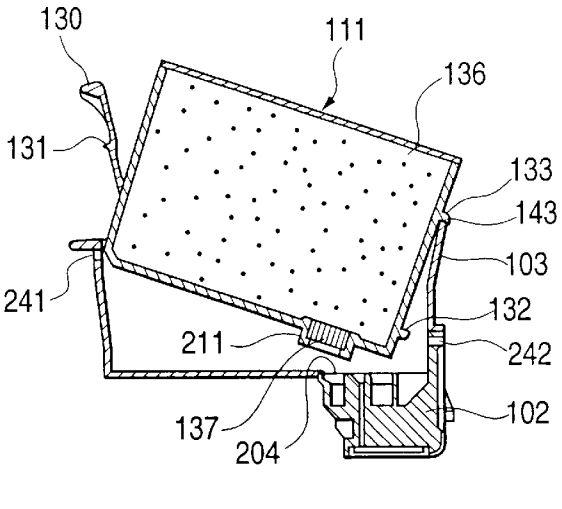
FIGS. 3A, 3B, 3C and 3D are cross-sectional views which illustrate the state in which the ink tank shown in FIGS. 2A, 2B and 2C is installed on the conventional tank holder shown in FIGS. 1A and 1B.
Figure 3D:
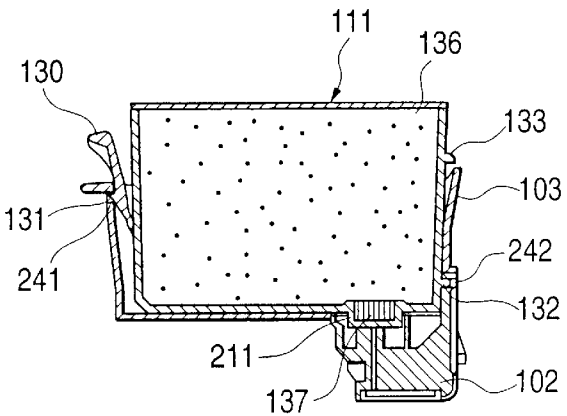
Figure 3A:
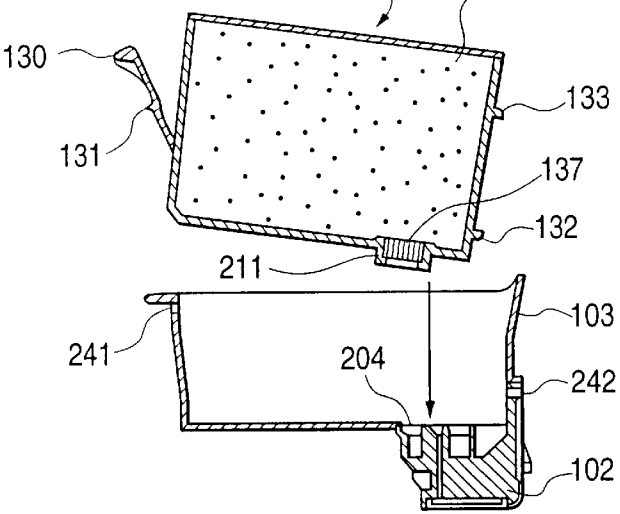
Figure 3C:
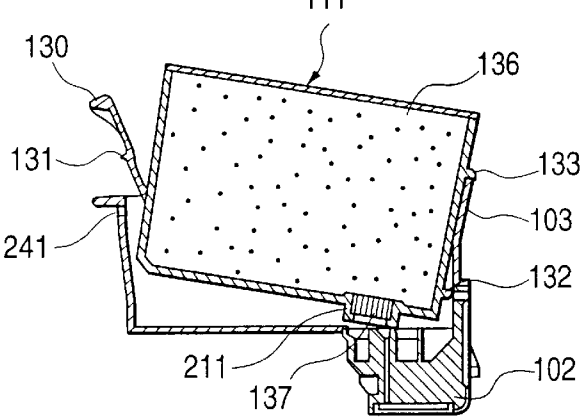
Figure 4A:
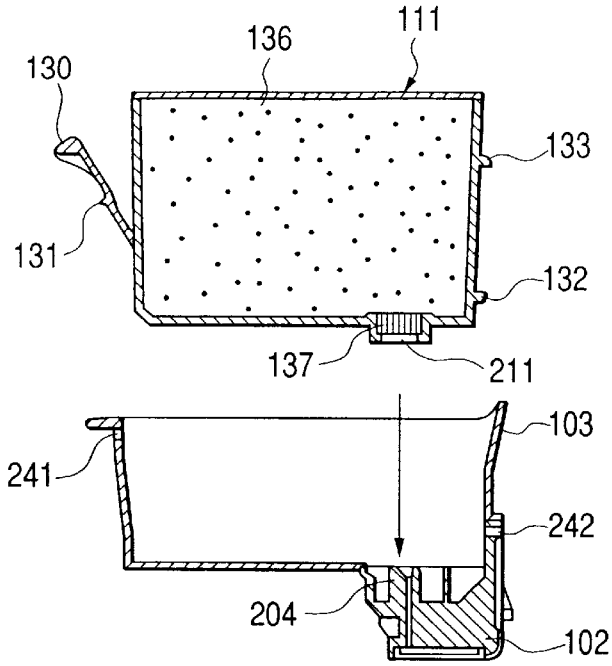
FIGS. 4A and 4B are views which illustrate the case where the ink tank shown in FIGS. 2A, 2B and 2C is held in the horizontal posture and installed on the tank holder shown in FIGS. 1A and 1B by being lowered straightly in such posture.
Figure 4B:
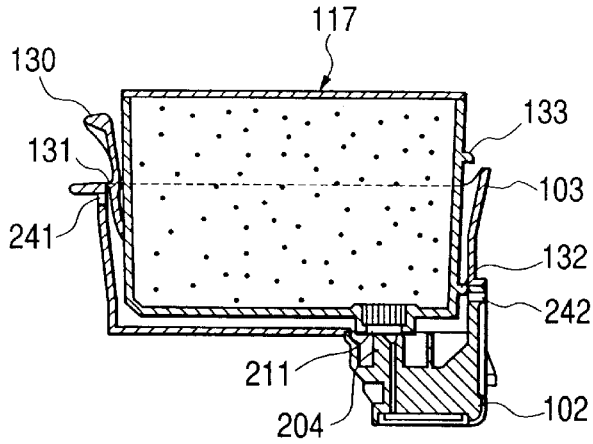
Figure 5:
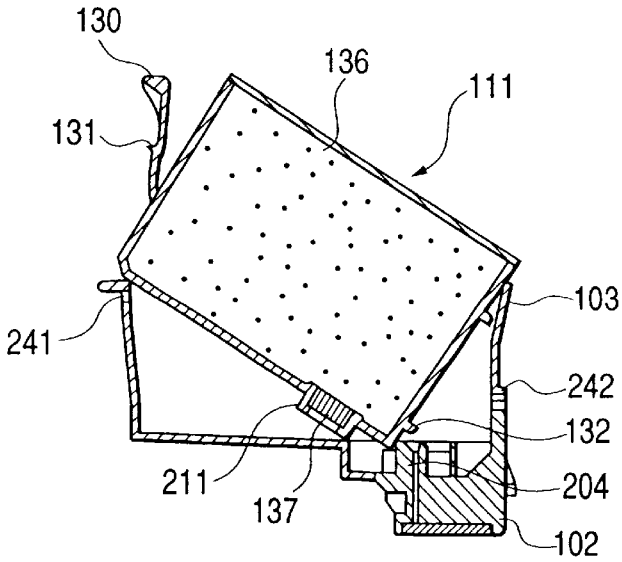
FIG. 5 is a cross-sectional view which shows the state where the ink tank shown in FIGS. 2A, 2B and 2C cannot be installed appropriately on the tank holder shown in FIGS. 1A and 1B.

Here, ink tanks are manufactured by way of trail with various changes of the difference between the distance S for the ink tank 30 and the distance W for the tank holder 36. Then, with the experiments by the actual installation thereof, it has been determined that the difference of 0.4 to 1.0 mm demonstrates the best condition. In other words, if the difference is small than 0.4 mm, the ink tank 30 is held to reside in the position in the half-finished manner as shown in FIGS. 4A and 4B (the position which the user tends to erroneously recognize as if the ink tank were installed appropriately). If, on the contrary, the difference is more than 1.0 mm, it becomes difficult to insert the second pawl 33*a* (33*b*) into the second hole 38*a* (38*b*) of the tank holder 36.

Now, in accordance with the p resent embodiment, the sectional configuration (the length of the extrusion) of the second pawl 33*a* (33*b*) is formed to be shorter on the lower side, and the lower side and the upper side are continuous on the inclined surface as shown in FIG. 9B or FIG. 10A.

Thus, by making the lower side of the second pawl 33*a* (33*b*) longer, it becomes possible to let the user recognize without fail that the installation status is inappropriate, because the first pawl and the second pawl are caught by the tank holder if the ink tank is held in the horizontal posture and the installation is intended on the tank holder from immediately above it in the condition that the ink tank is kept in such horizontal posture.

Here, when the installation is made appropriately, the upper side of the second pawl 33*a* (33*b*) advances from diagonally above to the second hold 38*a* (38*b*) of the tank holder. However, the upper side and the lower side are in the same length or the structure is arranged to make the upper side longer than the lower side, the upper side of the second pawl 33*a* (33*b*) may be in contact with the upper surface of the second hold 38*a* (38*b*) earlier, and such contact may impede the insertion thereof any further.

Therefore, the upper side of the second pawl 33*a* (33*b*) is made shorter than the lower side. Then, the insertion is made easier from diagonally above without letting the upper side of the second pawl 33*a* (33*b*) abut upon the second hole 38*a* (38*b*) when ink tank is installed. In this way, it becomes possible to make the rotational insertion with a part of the upper side of the second pawl 33*a* (33*b*) as the fulcrum assuredly.

As described above, the lower side of the second pawl 33*a* (33*b*) is longer, while the upper side thereof is made shorter, and then, the structure is arranged so that the lower side and the upper side is made continuous by means of the inclined surface. The ink tank is prevented from being installed on the tank holder in the wrong direction, and the normal installation is easily carried out without fail. These two functions are made executable satisfactorily at the same time.

Since the structure is formed as described above, the second pawl 33*a* (33*b*) is blocked in a position considerably above the second hole 38*a* (38*b*) of the tank holder 36 even if it is intended to install the ink tank 30, which is held in the horizontal posture as shown in FIG. 10A, on the tank holder 36 by lowering it straightly as it is as shown in FIG. 10B.

The first pawl 32 of the movable lever 31 is also blocked on the outer side of the tank holder 36 considerably above the first hold 38. Then, it becomes difficult to press the ink tank any further. Even if it is pressed down forcefully, the first pawl 32 is not allowed to engage with the first hole 38. Therefore, the use can recognize that the ink tank is not installed on the tank holder exactly. In this way, the user is prompted to operate again in order to install the ink tank correctly.

Also, it is preferable to make the height y of the second pawl 33*a* (33*b*) higher than the height x of the third pawl 34*a* (34*b*). This is because if the height x of the third pawl 34*a* (34*b*) is made equal to or higher than the height y of the second pawl 33*a* (33*b*), it becomes difficult for the third pawl to perform its function of guide as shown in FIGS. 9C and 9D or the pawl is stuck out to the outer side of the tank holder 36, and may undesirably interfere with the guide shaft of a printer in some cases (see the reference numeral 105 in FIG. 20).

In accordance with the present embodiment, the height y of the second pawl is 2.3 mm to 2.5 mm, while the height x of the third pawl is 1.7 to 2.0 mm. The second pawl is higher than the height x of the third pawl by 0.3 to 0.8 mm.

Here, in accordance with the present embodiment of the invention as described above, it is attempted to solve the subjects of the invention hereof by the adoption of the structure described above for the second engaging pawl. With the application of the structure of the present invention to the ink tank which is provided with the prism and the positioning pin, it is possible to demonstrate further effects as given below.

For example, the cartridge for black use shown in FIG. 6 and FIG. 7 is provided with the prism for use of the remainders detection in the ink tank, and the positioning pin 37 for positioning the ink tank when it is installed on the tank holder.

If the ink tank having the second pawl of the present invention is applied to the ink tank structured as described above, it becomes possible to prevent any forceful operation of ink tank installation. Then, the damage that may be caused to the positioning pin following the forceful installation is minimized. Therefore, even when the attaching and detaching operations are repeatedly performed, the damage to the positioning pin is controlled to maintain the highly precise tank installation. This is more preferable for the mode in which the presence or the absence of liquid in the ink tank is detected by the remainders detection mechanism provided with the prism and the light emitting means and photodetection means which are externally arranged (a recording apparatus main body or the like) as shown in FIG. 6 and FIG. 7, because such mode requires more rigid precision of the installed position of the ink tank on the tank holder.

Second Embodiment

Figure 11:
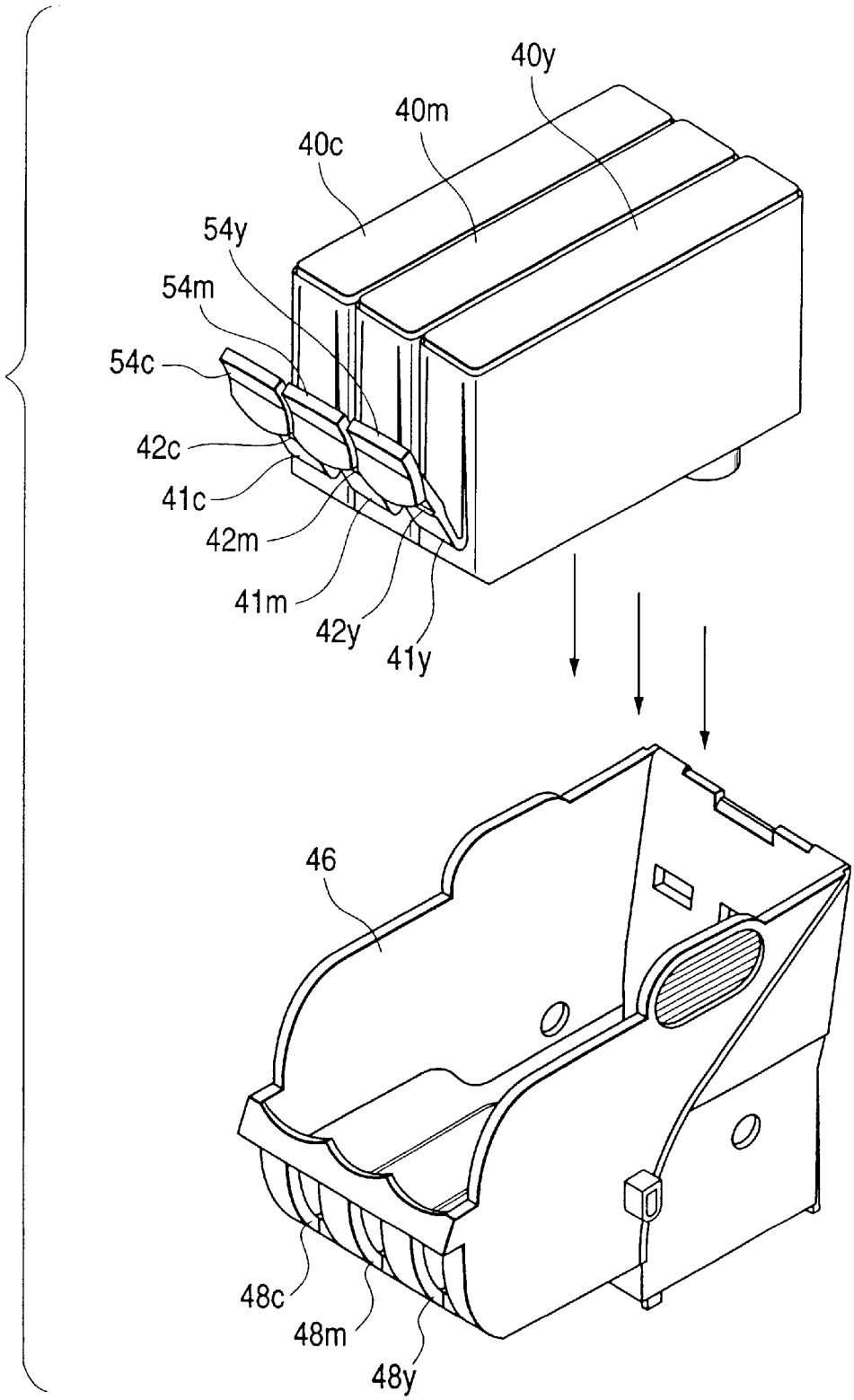
FIG. 11 is a perspective view which illustrate the front side of the ink tank and the tank holder that constitute the ink jet head cartridge for color use in accordance with a second embodiment of the present invention.
Figure 12:
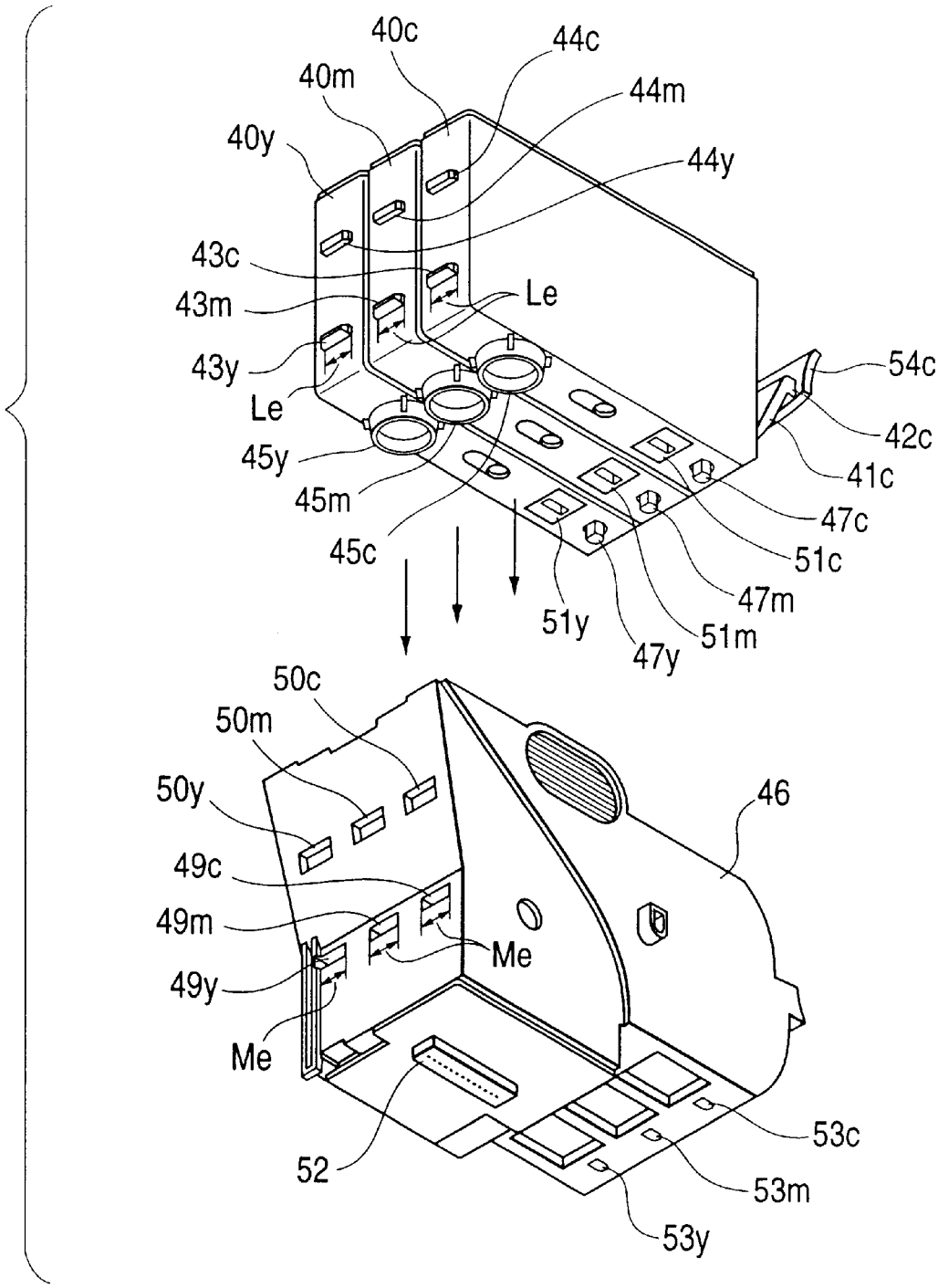
FIG. 12 is a perspective view which illustrate the back side of the ink tank and the tank holder that constitute the ink jet head cartridge for color use in accordance with the second embodiment of the present invention.

FIG. 11 is perspective views which illustrate the front side of the ink tank and the tank holder that constitute the ink jet head cartridge for color use in accordance with a second embodiment of the present invention, observed from diagonally right upper front side. FIG. 12 is perspective views which illustrate such ink tank and tank holder, observed from diagonally left lower back side.

The head cartridge for color use shown in FIG. 11 and FIG. 12 is provided with a cyan ink tank 40*c*, a magenta ink tank 40*m*, an yellow ink tank 40*y*, and the ink jet head, and it is structured with a tank holder 46 which can detachably hold each of the ink tanks 40*c*, 40*m*, and 40*y*. In the same manner as to the ink tank for black used described above, on one side of each of the color ink tanks 40*c*, 40*m*, and 40*y*, each of the movable levers 41*c*, 41*m*, and 41*y* is arranged. Each of the movable levers is provided with each of the nips 54*c*, 54*m*, and 54*y*, and each of the first pawls 42*c*, 42*m*, and 42*y*, respectively.

On the other side face of each of the color ink tanks 40*c*, 40*m*, and 40*y*, each of the second pawls 43*c*, 43*m*, and 43*y* is arranged. Further, on the other side of each of the color ink tanks 40*c*, 40*m*, and 40*y*, the third pawls 44*c*, 44*m*, and 44*y* are arranged above the second pawls 43*c*, 43*m*, and 43*y*, respectively.

On the lower part of the ink tank 40*c* (40*m* and 40*y*), there are provided the ink supply port 45*c* (45*m* and 45*y*) which cylindrically protrudes from the bottom face of the tank; the position pin 47*c* (47*m* and 47*y*) used when the ink tank 40*c* (40*m* and 40*y*) is installed on the tank holder 46; and the prism 51*c* (51*m* and 51*y*) used for detecting the ink remainders in the tank.

Also, for the tank holder 46, the first hole 48*c* (48*m* and 48*y*) and the second hole 49*c* (49*m* and 49*y*) are formed with which the first pawl 42*c* (42*m* and 42*y*) and the second pawl 43*c* (43*m* and 43*y*) engage, respectively, when the ink tank 40*c* (40*m* and 40*y*) is installed on the tank holder 46. Further, for the tank holder 46, the third holes 50*c* (50*m* and 50*y*) is formed where the third pawl 44*c*(44*m* and 44*y*) is allowed to fall into it once, respectively, for positioning during the installation process of each ink tank on the tank holder 46. Further, on the lower part of the tank holder 46, the positioning hole 53*c* (53*m* and 53*y*) is arranged to enable the positioning pin 47*c* (47*m* and 47*y*) of the ink tank 40*c* (40*m* and 40*y*) to be fitted.

In this manner, each of the ink tanks is detachably installed on the tank holder. Then, each of the ink tanks is made exchangeable, thus reducing the running costs of printing operation of an ink jet recording apparatus.

Figure 13:
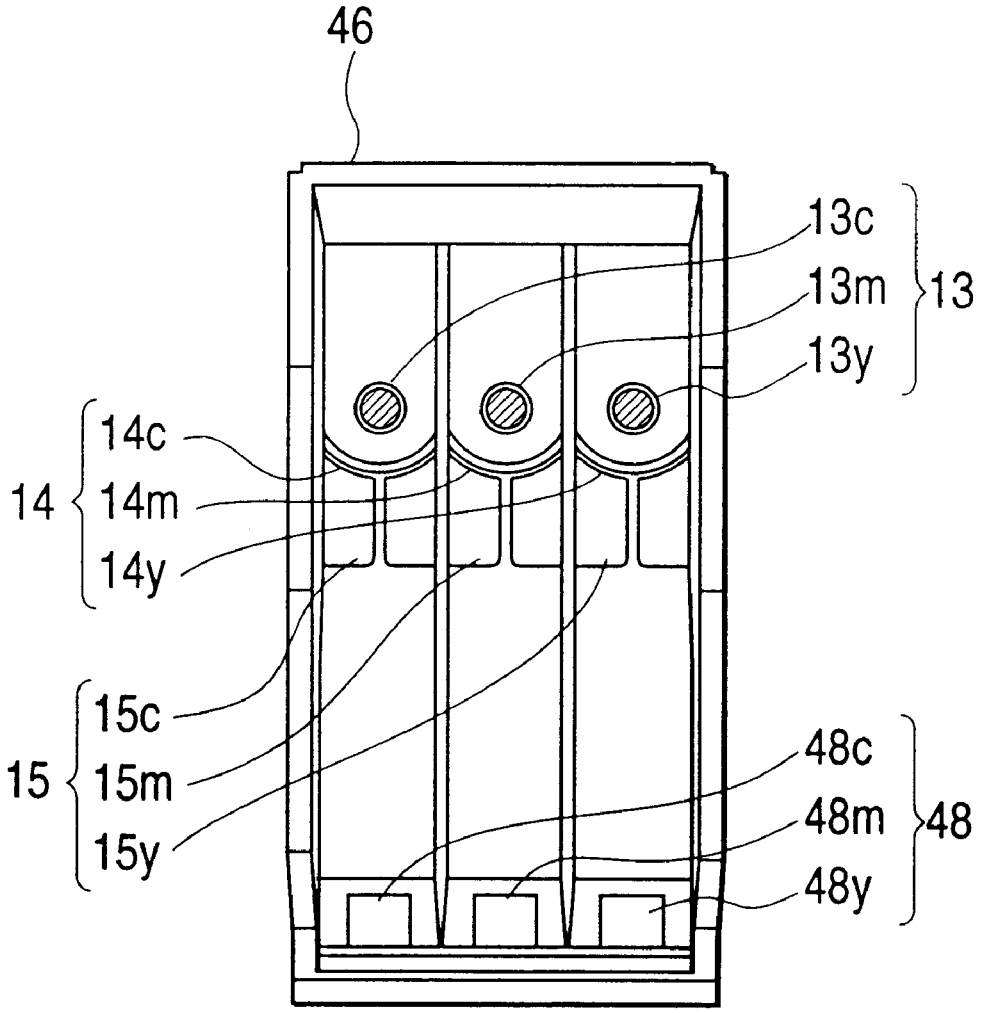
FIG. 13 is the top view which shows the tank holder in accordance with the second embodiment of the present invention.

In accordance with the present embodiment, too, there are provided, as in the first embodiment, the semicircular rib 14 (14*y*, 14*m*, and 14*c*) and the linear rib 15 (15*y*, 15*m*, and 15*c*) on the side of the joint 13 (13*y*, 13*m*, and 13*c*) of the tank holder 46 as clear from the representation of the tank holder 46 on the top view shown in FIG. 13. Therefore, the use can easily install the ink tanks on the tank holder.

Also, the distance S (see FIG. 10) between the outer side face of the base portion of the movable lever of the ink tank and the leading end of the second engaging pawl is set is set greater than the distance W (see FIG. 10) between the inner side faces of the side wall having the first engagement hale and the side wall having the second engagement hole of the tank holder. Then, unless the correct operation is carried out, the ink tank is not fixed to the tank holder because the tank does not engage with the holder. With a simple and an inexpensive method, it becomes possible to let the user install the ink tank on the tank holder correctly and safely without difficulty.

Now, the detailed description will be made of the structure adopted for preventing the erroneous installation of the ink tank of the present embodiment, and the ink tank of the first embodiment.

As shown in FIG. 6, two engaging pawls (the second pawls) 33*a* and 33*b* are provided for one side face (back face) of the large capacity ink tank 30 for black ink use of the first embodiment. Further, above each of the second pawls 33*a* and 33*b* in the vertical direction on the same side face, the tired pawls 34*a* and 34*b* are arranged, respectively. Further, on the side face (front face) opposite to the side face where the second pawls 33*a* and 33*b* are provided, the first pawl 32 is arranged for the movable lever 31. For the tank holder 36, there are arranged the second holes 38*a* and 38*b*, and the third holes 39*a* and 39*b* to receive the second pawls 33*a* and 33*b*, and the third pawls 34*a* and 34*b*, respectively.

Now, each length of the second pawls 33*a* and 33*b*of the ink tank 30 in the transverse direction (the width direction of the ink tank) is defined as La, and the gap between the second pawls 33*a* and 33*b* is defined as Lc. Also, each length of the second holes 38*a* and 38*b* of the tank holder 36 in the transverse direction (the width direction of the tank holder) is defined as Ma, and the gap between the second holes 38*a* and 38*b* is defined as Mc.

Then, the length Ma of the second hole is made longer than the length La by 0.02 to 0.12 mm so as to enable the second pawls 33*a* and 33*b* to be inserted into the second holes 38*a* and 38*b*.

For the present embodiment, the following dimensional values are adopted:

La=2.920 to 2.970 mm, Lc=9.0±0.1 mm

Ma=3.000 to 3.050 mm, Mc=9.0±0.1 mm

Also, as shown in FIG. 11, the engaging pawls (the second pawls) 43*y*, 43*m*, and 43*c* are provided for one side face (back face) of each of the ink tanks 40*y*, 40*m*, and 40*c* for color use of the second embodiment. Further, above each of the second pawls 43*y*, 43*m*, and 43*c* in the vertical direction on the same side face, the tired pawls 44*y*, 44*m*, and 44*c* are arranged, respectively. Further, on the side face (front face) opposite to the side face where the second pawls 43*y*, 43*m*, and 43*c* are provided, the first pawls 42*y*, 42*m*, and 42*c* are arranged for the movable levers 41*y*, 41*m*, and 41*c*, respectively. For the tank holder 46, there are arranged the second holes 49*y*, 49*m*, and 49*c*, and the third holes 50*y*, 50*m*, and 50*c* to receive the second pawls 49*m*,49*m*, and 49*c*, and the third pawls 50*y*, 50*m*, and 50*c*, respectively.

Now, each length of the second pawls 43*y*, 43*m*, and 43*c* of each of the color ink tanks 40*y*, 40*m*, and 40*c* is the same, respectively, in the transverse direction (the width direction of the ink tank), and defined as Le, and each length of the second holes 49*y*, 49*m*, and 49*c* of the tank holder 46 is the same, respectively, in the transverse direction (the width direction of the tank holder) and defined as Me.

Then, the length Me of the second hole is made longer than the length Le by 0.02 to 0.12 mm so as to enable the second pawls 43*y*, 43*m*, and 43*c* to be inserted into the second holes 49*y*, 49*m*, and 49*c*.

For the present embodiment, the following dimensional values are adopted:

Le=6.920 to 6.970 mm

Me=7.000 to 7.050 mm

With the structure described above, if the relationship of Lc+2La>Me and/or Lc>Me is satisfied at least, there is no possibility that the second pawls 33*a* and 33*b* of the large capacity ink tank 30 for black ink use are allowed to engage with the second holes 49*y*, 49*m*, and 49*c* of the tank holder 46 for color use. Also, if the relationship of Le>Ma or Mc>Le is satisfied, there is no possibility that each of the second pawls 43*y*, 43*m*, and 43*c* of the ink tanks 40*y*, 40*m*, and 40*c* for color use is allowed to engage with the second holes 38*a* and 38*b* of the tank holder 36 for black ink use.

In this way, it is made possible for the user to recognize the position where the ink tank should be installed on the tank holder exactly.

Third Embodiment

Figure 14A:
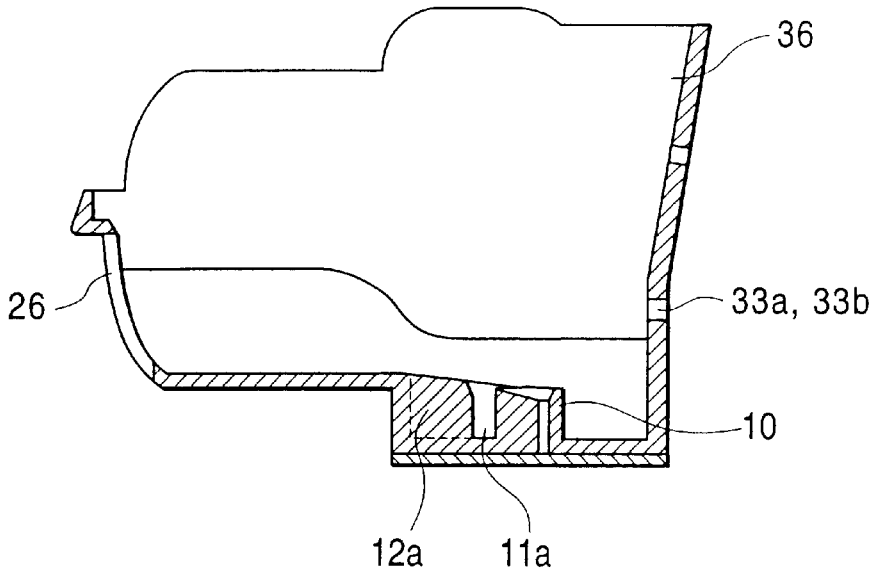
FIGS. 14A and 14B are views which schematically illustrate a tank holder in accordance with a third embodiment of the present invention.
Figure 14B:
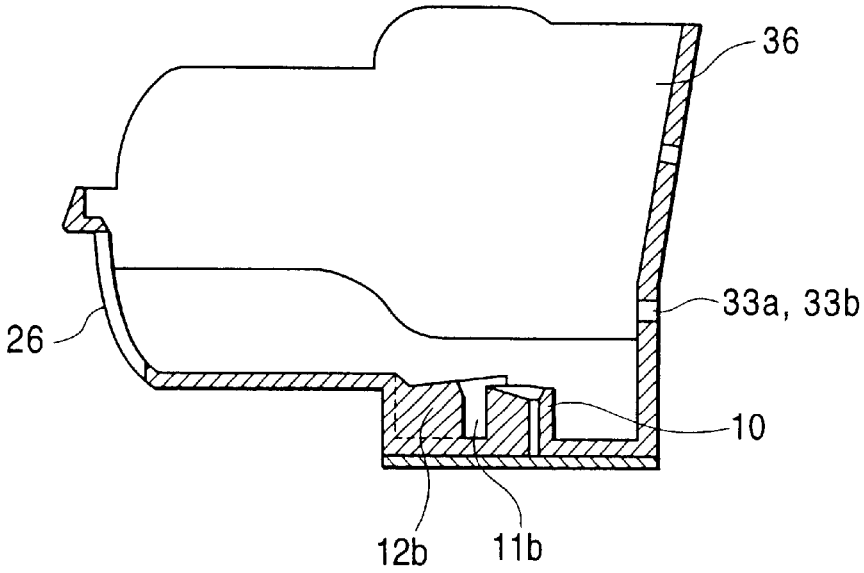

FIGS. 14A and 14B are cross-sectional views which illustrate the principal part of the ink jet head cartridge in accordance with a third embodiment of the present invention. The present embodiment is the variational example of the first embodiment. For the parts where no variation is made, the same reference marks are applied. Then, the description thereof will be omitted.

In accordance with the present embodiment, the semicircular rib and the linear rib are changed. FIG. 14A shows the state where each height of the semicircular rib 11*a* and the linear rib 12*a* is arranged to become lower gradually as each of them approach the joint 10 more closely. FIG. 14B shows the state where each height of the semicircular rib 11*b* and the linear rib 12*b* is arranged to become higher gradually on the contrary.

Even if the configuration of the installing ink tank is complicated, it is possible to install the ink tank smoothly on the tank holder either in one of the modes shown in FIG. 14A and FIG. 14B.

Fourth Embodiment

Hereunder, the description will be made of the structure with which the user is allowed to recognize whether or not plural kinds of ink tanks are correctly installed on the tank holder for color use which forms the head cartridge for color use.

Figure 15:
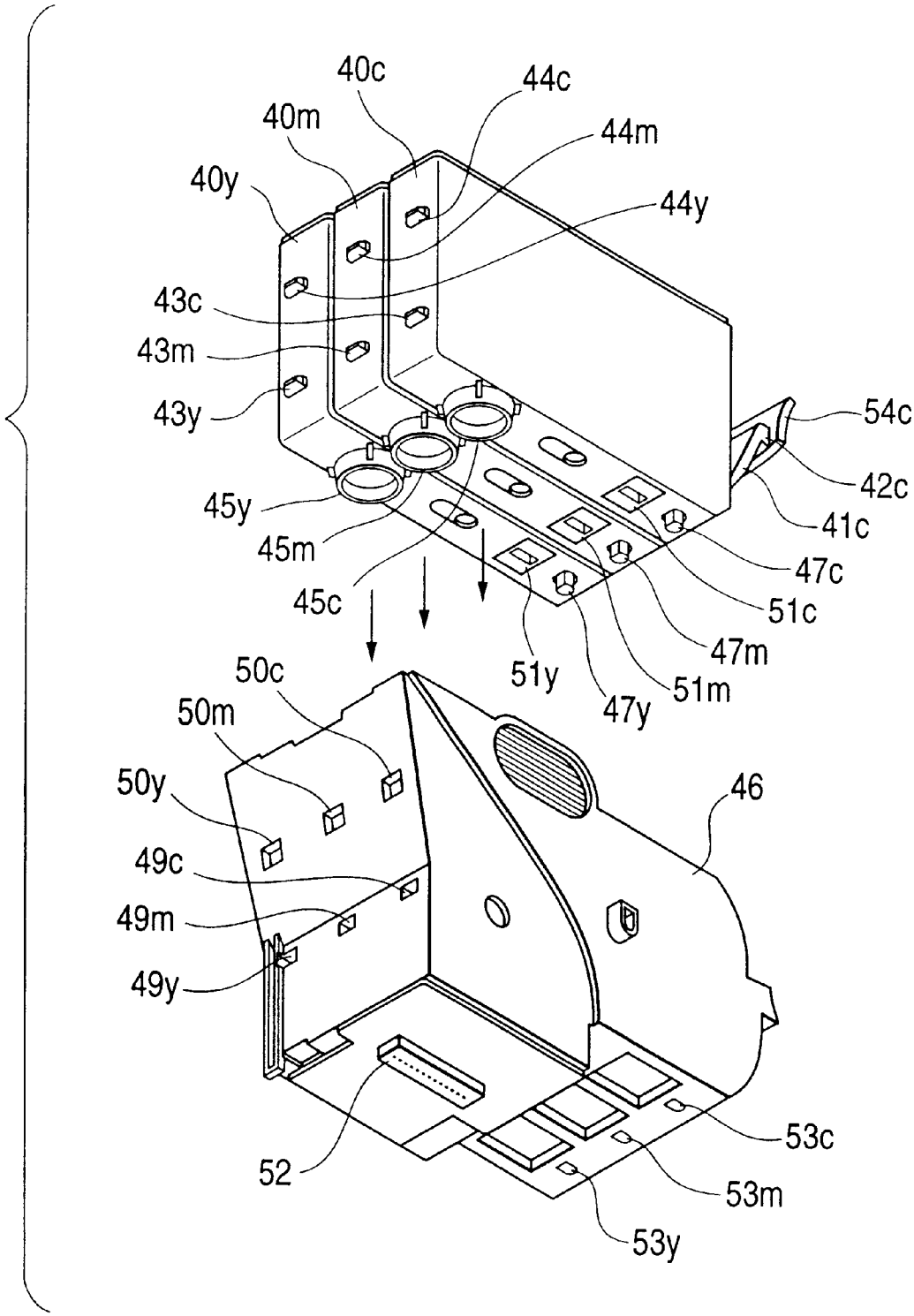
FIG. 15 is a view which illustrate the ink tank and the tank holder that constitute an ink jet head cartridge in accordance with a fourth embodiment of the present invention.

FIG. 15 is a view which shows the head cartridge for color use in accordance with a fourth embodiment of the present invention, observed from diagonally lower left back face.

Although described in conjunction with the second embodiment, on each one side face (back face) of the ink tanks for color use 40*y*, 40*m*, and 40*c* the engaging pawls (the second pawls) 43*y*, 43*m*, and 43*c* are arranged as shown in FIG. 6. Further, above the second pawls 43*y*, 43*m*, and 43*c* in the vertical direction on the same side face, the third pawls 44*y*, 44*m*, and 44*c*are arranged. Further, on the side face (front face) opposite to the side where the second pawls 43*y*, 43*m*, and 43*c* are arranged, the first pawls 42*y*, 42*m*, and 42*c* are arranged for the movable levers 41*y*, 41*m*, and 41*c*. On the tank holder 46, the second holes 49*y*, 49*m*, and 49*c*, and also, the third holes 50*y*, 50*m*, and 50*c* are arranged to receive the second pawls 43*y*, 43*m*, and 43*c* and the third pawls 44*y*, 44*m*, and 44*c*, respectively.

In accordance with the present embodiment, although each length of the second pawls 43*y*, 43*m*, and 43*c* in the transverse direction (the width direction of the ink tank) is the same, each position of the second pawls is changed so that the second pawl for the cyan ink tank 40*c* is positioned at the right end toward the back face; the one for the magenta ink tank 40*m*, in the center; and the one for the yellow ink tank 40*y*, on the left end, respectively. Further, for the third pawls 44*y*, 44*m*, and 44*c* positioned above the second pawls 43*y*, 43*m*, and 43*c* in the vertical direction, the positional changes are made likewise per color ink tank. Also, each position of the second holes 49*y*, 49*m*, and 49*c* and the third holes 50*y*, 50*m*, and 50*c* of the tank holder 46 that correspond to the second pawls 43*y*, 43*m*, and 43*c* and the third pawls 44*y*, 44*m*, and 44*c*, respectively, is changed to be on the right end, in the center, and the left end accordingly.

With the structure thus arranged, the second pawl 43*y* and the third pawl 44*y* of the yellow ink tank 40*y* engage only with the corresponding second hole 49*y* and third hole 50*y* of the tank holder 46, but do not engage with any other second holes 49*m* and 49*c* or the third holes 50*m* and 50*c*. The same is applicable to the pawls of the magenta ink tank 40*m* or the cyan ink tank 40*c*. These are not allowed to engage with the holes unless corresponding to each other.

In other words, the engaging pawl on the back face of each color ink tank is arranged to engage with the hole of the tank holder only in the position determined correctly for each of color ink tanks for the tank holder accordingly. Therefore, it is made possible for the user to recognize whether or not the respective ink tanks are correctly installed on the tank holder.

Fifth Embodiment

In this respect, too, the description will be made of the structure as the variational example of the fourth embodiment, with which the user is allowed to recognize whether or not plural kinds of ink tanks are correctly installed on the tank holder for color use which forms the color head cartridge. Also, here, the aspects which are different from those of the fourth embodiment will be described.

Figure 16:
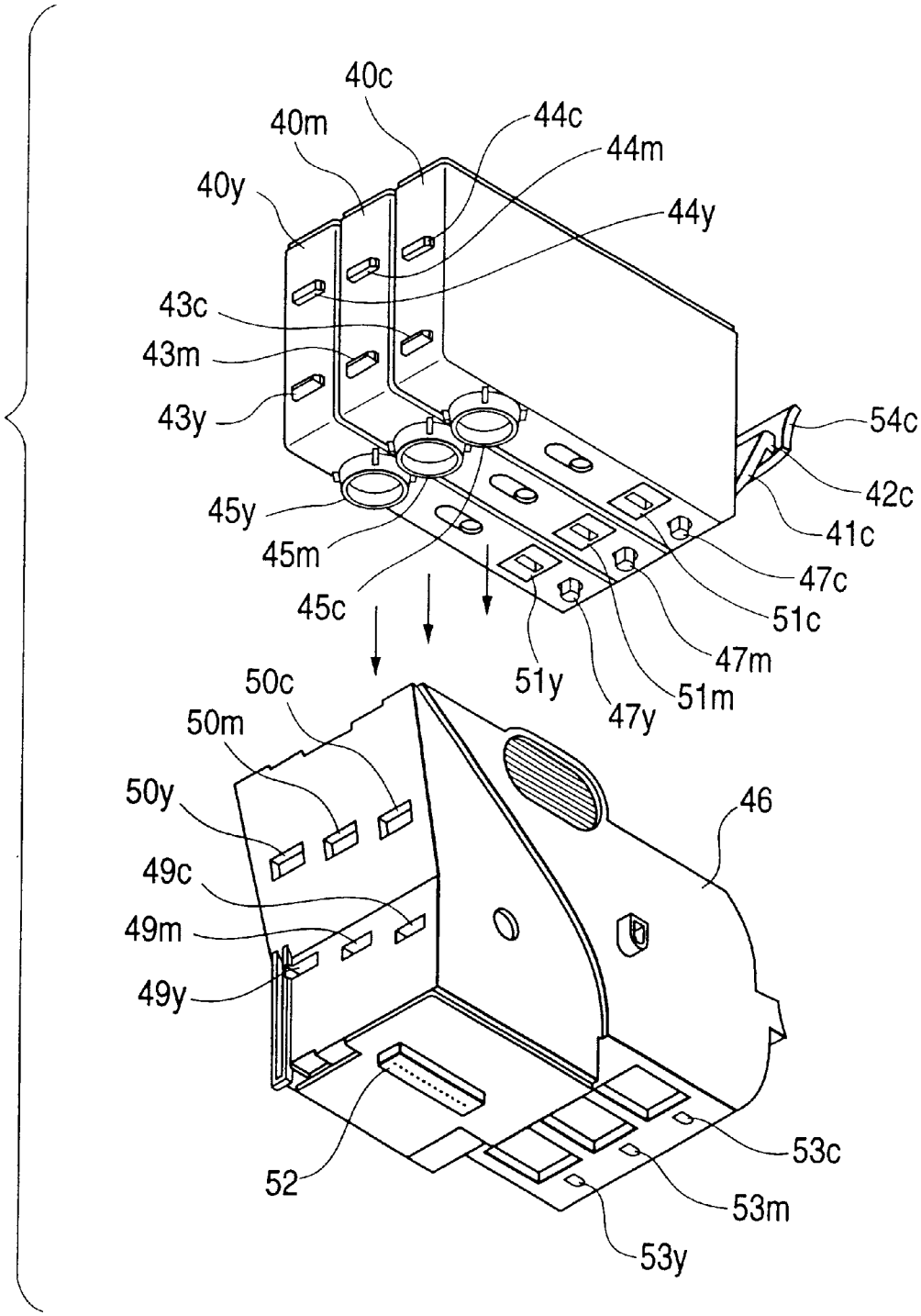
FIG. 16 is a view which illustrate the ink tank and the tank holder that constitute an ink jet head cartridge in accordance with a fifth embodiment of the present invention.

FIG. 16 is a view which shows the head cartridge for color use in accordance with a fifth embodiment of the present invention, observed from diagonally lower left back face.

Although as described in FIG. 16, each length of the second pawls 43*y*, 43*m*, and 43*c* of the color ink tanks 40*y*, 40*m*, and 40*c* is the same in the transverse direction (the width direction of the ink tank), each position of the second pawls is changed so that the one for the cyan ink tank 40*c* is deviated to the lower end side on the back face; the one for the magenta ink tank 40*m*, slightly above the cyan tank 40*c*; and the one for the yellow ink tank 40*y*, slightly above the magenta tank 40*m*. Further, above the second pawls 43*y*, 43*m*, and 43*c* in the vertical direction on the same side face, the third pawls 44*y*, 44*m*, and 44*c* are arranged, and for these third pawls, too, the same changes are made per color tank. Also, each position of the second holes 49*y*, 49*m*, and 49*c* and the third holes 50*y*, 50*m*, and 50*c* of the tank holder 46 is changed corresponding to the second pawls 43*y*, 43*m*, and 43*c* and the third pawls 44*y*, 44*m*, and 44*c*accordingly.

With the structure thus arranged, the second pawl 43*y* and the third pawl 44*y* of the yellow ink tank 40*y*engage only with the corresponding second hole 49*y* and third hole 50*y* of the tank holder 46, but do not engage with any other second holes 49*m* and 49*c* or the third holes 50*m* and 50*c*. The same is applicable to the pawls of the magenta ink tank 40*m* or the cyan ink tank 40*c*. These are not allowed to engage with the holes unless corresponding to each other.

In other words, the engaging pawl on the back face of each color ink tank is arranged to engage with the hole of the tank holder only in the position determined correctly for each Of color ink tanks for the tank holder accordingly. Therefore, it is made possible for the user to recognize whether or not the respective ink tanks are correctly installed on the tank holder.

Sixth Embodiment

In this respect, too, the description will be made of the structure as the variational example of the fourth embodiment, with which the user is allowed to recognize whether or not plural kinds of ink tanks are correctly installed on the tank holder for color use which forms the color head cartridge. Also, here, the aspects which are different from those of the third embodiment will be described.

Figure 17:
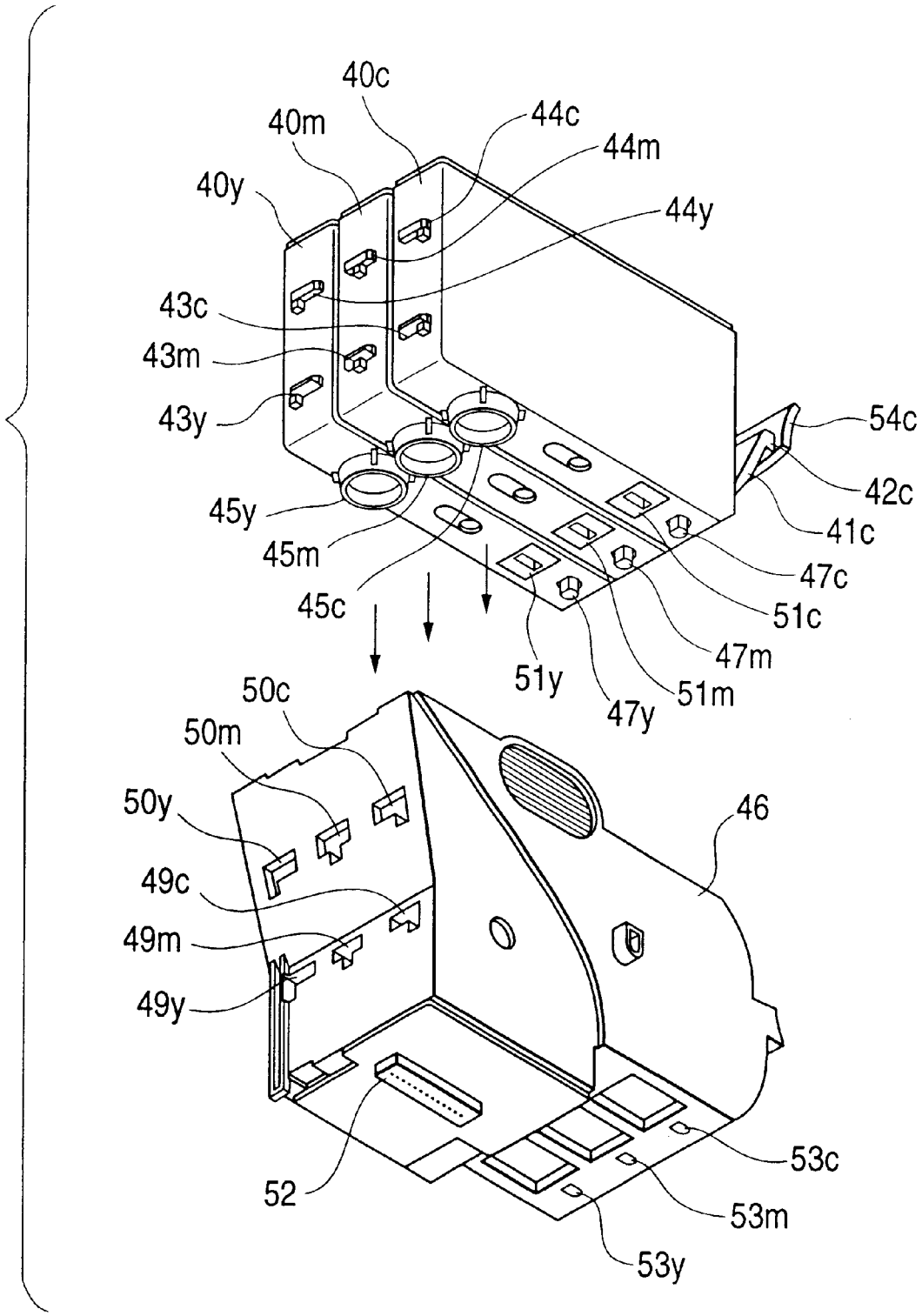
FIG. 17 is a view which illustrate the ink tank and the tank holder that constitute an ink jet head cartridge in accordance with a sixth embodiment of the present invention.

FIG. 17 shows the head cartridge for color use in accordance with a sixth embodiment of the present invention, observed from diagonally lower left back face.

A shown in FIG. 17, in accordance with the present embodiment, each pawl configuration of the second pawls 43*y*, 43*m*, and 43*c* of the color ink tanks 40*y*, 40*m*, and 40*c* is changed so that for the one for the cyan ink tank 40*c* has a convex extrusion in the lower right end of the rectangular parallelepiped; the one for the magenta ink tank 40*m*, in the lower central portion thereof; and the one for the yellow ink tank 40*y*, on the lower left end, respectively. Further, above the second pawls 43*y*, 43*m*, and 43*c* in the vertical direction on the same side face, the third pawls 44*y*, 44*m*, and 44*c*are arranged, and for these third pawls, too, the same changes are made per color tank. Also, each configuration of the second holes 49*y*, 49*m*, and 49*c* and the third holes 50*y*, 50*m*, and 50*c* of the tank holder 46 is changed corresponding to the second pawls 43*y*, 43*m*, and 43*c* and the third pawls 44*y*, 44*m*, and 44*c* accordingly.

With the structure thus arranged, the second pawl 43*y* and the third pawl 44*y* of the yellow ink tank 40*y* engage only with the corresponding second hole 49*y* and third hole 50*y* of the tank holder 46, but do not engage with any other second holes 49*m* and 49*c* or the third holes 50*m* and 50*c*. The same is applicable to the pawls of the magenta ink tank 40*m* or the cyan ink tank 40*c*. These are not allowed to engage with the holes unless corresponding to each other.

In other words, the engaging pawl on the back face of each color ink tank is arranged to engage with the hole of the tank holder only in the position determined correctly for each of color ink tanks for the tank holder accordingly. Therefore, it is made possible for the user to recognize whether or not the respective ink tanks are correctly installed on the tank holder.

Seventh Embodiment

Here, the description will be made of the structure with which the user is able to recognize the erroneous installation for the monochromatic tank holder where one of the ink tanks having different capacities is exchangeably installed.

Figure 18:
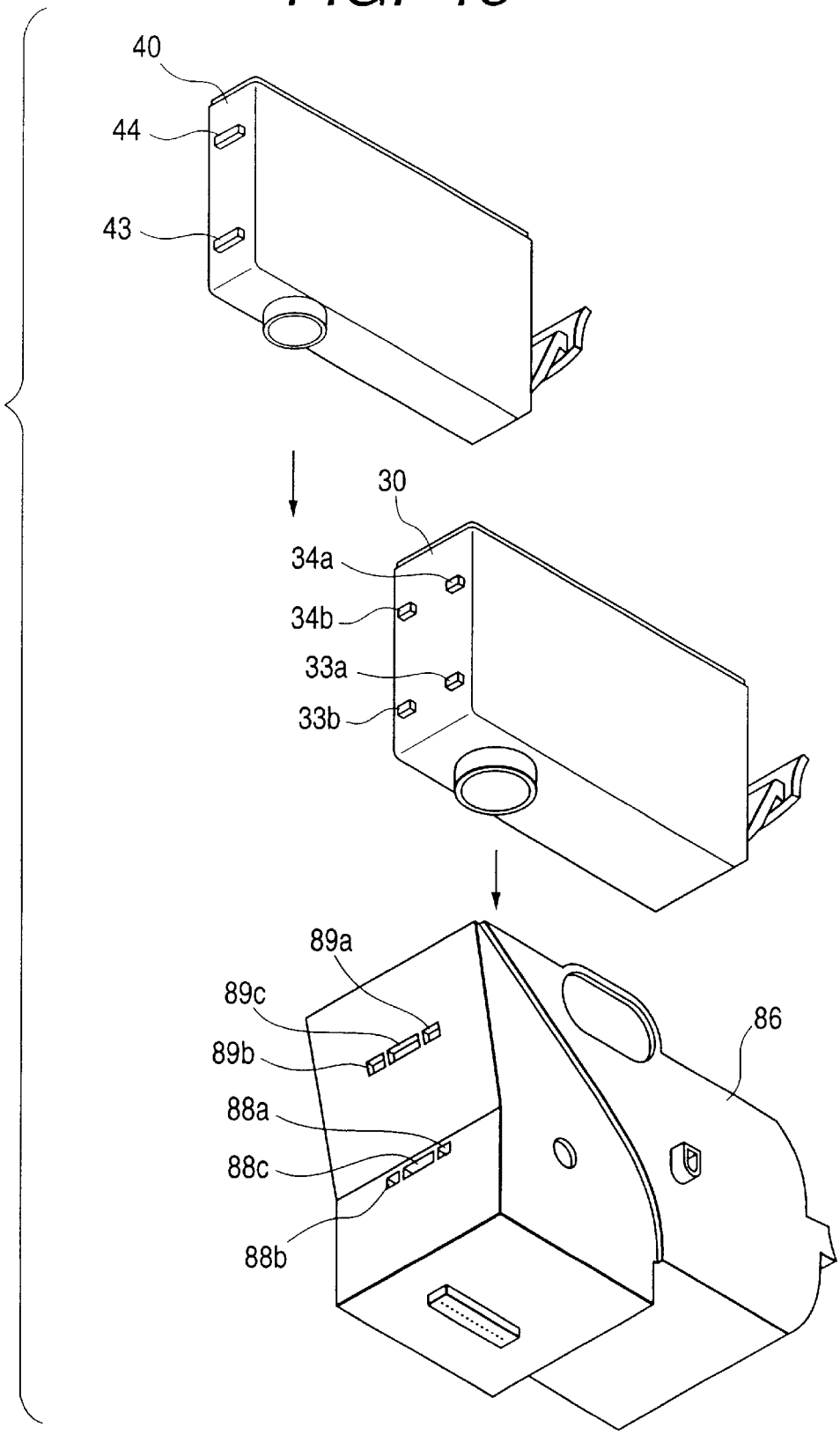
FIG. 18 is a perspective view which illustrate the monochromatic tank holder of the head cartridge, and a large capacity ink tank, as well as a small capacity ink tank in accordance with a seventh embodiment of the present invention.
Figure 19A:
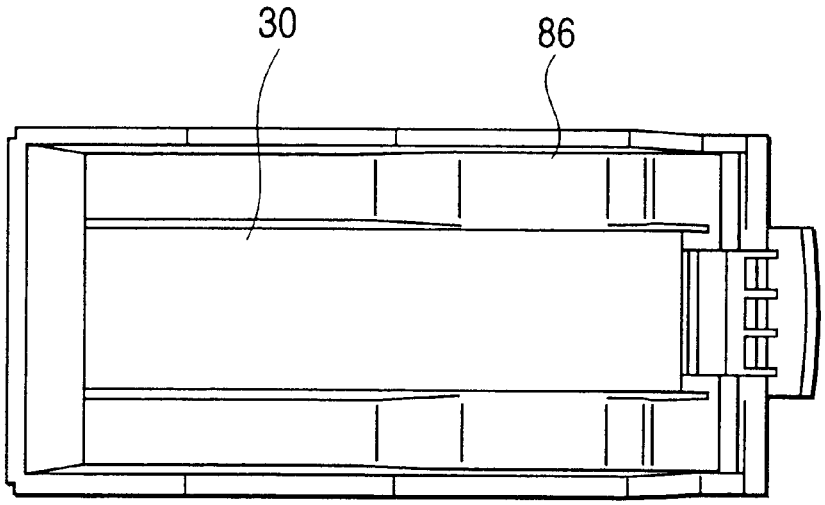
FIGS. 19A and 19B are plan views which illustrate the state where the large capacity ink tank (small capacity ink tank) is installed on the monochromatic tank holder shown in FIG. 18.
Figure 19B:
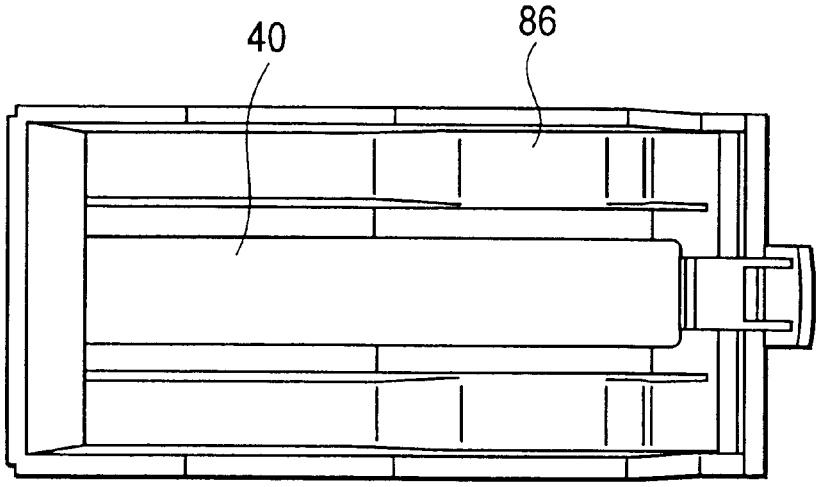

FIG. 18 is a perspective view which shows the monochromatic tank holder for the head cartridge, and the larger and smaller ink tanks in accordance with a seventh embodiment of the present invention. FIG. 19A is a plan view which shows the state where the larger capacity ink tank is installed on the monochromatic tank holder. FIG. 19B is a plan view which shows the state where a smaller capacity ink tank is installed on the monochromatic tank holder.

In FIG. 18, the ink tank 30 and the ink tank 40 are the same as those of the first and second embodiments. The dimensional values of the second pawls are also the same, respectively.

For the tank holder 86, there are arranged the second holes 88*a* (right) and 88*b* (left) to engage with the second pawls 33*a* and 33*b* of the ink tank 30, respectively. The second hold 88*c* (center) is also arranged to engage with the second pawl 43 of the ink tank 40. The dimensional value of the second hole 88*a* (right) is the same as that of the second hole 38*a* (see FIG. 7) in accordance with the first embodiment. The dimensional value of the second hole 88*b* (left) is the same as that of the second hole 38*b* (see FIG. 7) in accordance with the first embodiment. The dimensional value of the second hole 88*c* (center) is the same as those of the second holes 49*y*, 49*m*, and 49*c* (see FIG. 12) in accordance with the second embodiment.

With the structure thus arranged, it becomes possible to install both the ink tank 30 and the ink tank 40 on the tank holder 86 correctly as shown in FIGS. 19A and 19B. In other words, in accordance with the present embodiment, the user can install plural kinds of ink tanks on one holder correctly.

Now that the principal part of the present invention has been described as above, the description will be made of the ink jet recording apparatus to which each of the embodiments of the invention is preferably applicable as given below. Here, unless otherwise stated, each of the embodiments described above or the combination thereof is applicable to the recording apparatus given below.

Figure 20:
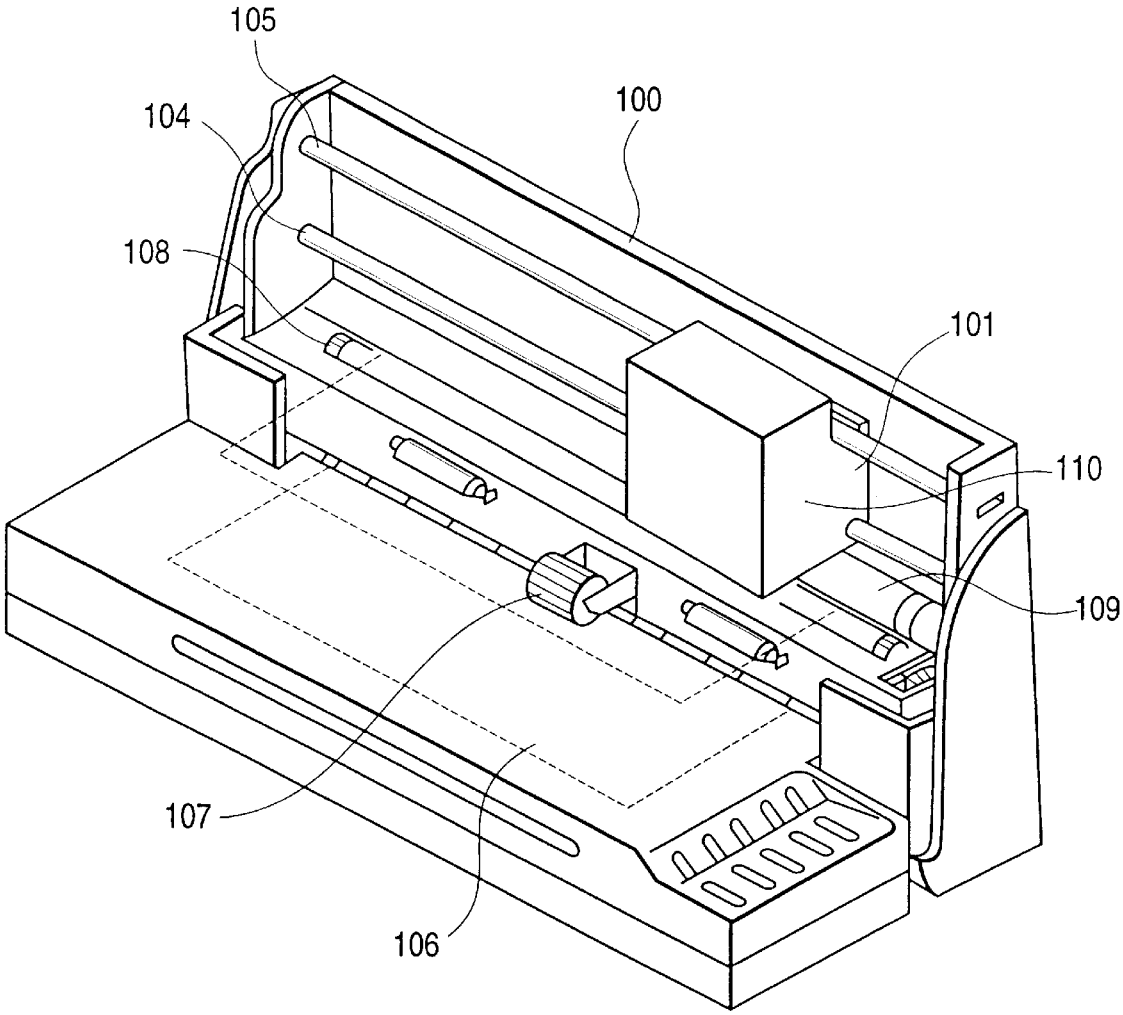
FIG. 20 is a perspective view which schematically shows the ink jet recording apparatus to which the present invention is applicable.

FIG. 20 is a perspective view which schematically shows the ink jet recording apparatus capable of mounting on it the ink jet head cartridge and the ink tank of the present invention.

For the ink jet recording apparatus shown in FIG. 20, the lead screw 104 and the guide shaft 105, which are arranged to be in parallel to each other, are provided in a housing. For the lead screw 104 and the guide shaft 105, the carriage 101 is movably installed in the direction parallel to the lead screw 104 and the guide shaft 105. The carriage 101 moves in parallel with the lead screw 104 when the lead screw rotates by means of a carriage motor (not shown).

For the carriage 101, the ink jet head cartridge provided with the ink jet head 110 is mounted. In the vicinity of the movement locus plane of the discharge port surface of the ink jet head 110, the sheet pressure plate 109 is arranged.

Also, the ink jet recording apparatus is provided with the sheet feed roller 107 that carries the recording sheet 106 which serves as a recording medium toward the recording area of the ink jet head 110, and the sheet exhaust roller 108 for exhausting the recording sheet 106 after recording by use of the ink jet head 110. The sheet feed roller 107 and the sheet exhaust roller 108 are rotated by means of a motor (not shown).

Ink discharged from the ink jet head 110 adheres to the recording sheet 106 which faces the discharge port surface of the ink jet head 102. Thus, images are recorded on the surface of the recording sheet 106. Interlocked with the recording to the recording sheet 106 by the ink jet head 102, the recording sheet 106 is exhausted outside the ink jet recording apparatus by the operation of the sheet feed roller 107 and the sheet exhaust roller 108, as well as the sheet pressure plate 109.

In this respect, it may be possible to mount tow different kinds of head cartridges on the carriage of the recording apparatus described above. In this case, provided that the cartridges can mount three color ink tanks each as in the second embodiment, the two head cartridges may be one photographic head cartridge having magenta and cyan tanks for use of lighter density colors, as well as the black ink tank, and one color head cartridge that can discharge yellow, magenta, and cyan ink. With the combination thus arranged, the recording apparatus can print in six ink colors, and also, it can print in the photographic mode or the aforesaid photographic head cartridge may be replaced with the ink tank only for black use as in the first embodiment so that a text printing can be made at higher speeds, and that images are printed in business colors at higher speeds as required.

What is claimed is:

1. An ink tank detachably holdable on a tank holder which includes first and second side walls opposed to each other and respectively having first and second engagement holes, said ink tank comprising:

an ink tank body;

a movable lever on said ink tank body, said movable lever having a first engaging pawl to engage with the first engagement hole; and a second engaging pawl on said ink tank body, said second engaging pawl to engage with the second engagement hole, wherein a distance S between an outer side face of a base portion of said movable lever and a leading end of said second engaging pawl is set to be longer by 0.4 mm to 1.0 mm than a distance W between inner wall faces of the first and second side walls; and wherein a length of a lower side of an extrusion of said second engaging pawl is longer than that of upper side thereof, and the upper side and the lower side are made continuous by an inclined face.

2. An ink tank detachably holdable on a tank holder which includes first and second side walls opposed to each other and respectively having first and second engagement holes, said ink tank comprising:

an ink tank body;

a movable lever on said ink tank body, said movable lever having a first engaging pawl to engage with the first engagement hole; and a second engaging pawl on said ink tank body, said second engaging pawl to engage with the second engagement hole, further comprising:

a third engagement pawl on a same side face of said ink tank body as said second engaging pawl, said third engaging pawl being arranged above said second engaging pawl, and a length of said second engaging pawl being greater than that of said third engaging pawl;

wherein a distance S between an outer side face of a base portion of said movable lever and a leading end of said second engaging pawl is set to be larger than a distance W between inner wall faces of the first and second side walls of said tank holder; and wherein said distance S of the ink tank is longer than the distance W of the tank holder by 0.4 mm to 1.0 mm.

3. An ink tank according to claim 2, wherein said length of the second engaging pawl of said ink tank is greater than that of said third engaging pawl by 0.3 mm to 1.2 mm.

4. An ink tank detachably holdable on a tank holder which includes first and second side walls opposed to each other and respectively having first and second engagement holes, said ink tank comprising:

an ink tank body;

a movable lever on said ink tank body, said movable lever having a first engaging pawl to engage with the first engagement hole;

a second engaging pawl on said ink tank body, said second engaging pawl to engage with the second engagement hole; and a third engaging pawl on a same side face of said ink tank body as said second engaging pawl, said third engaging pawl being arranged above said second engaging pawl, said third engaging pawl for engagement with a third engagement hole of said tank holder;

wherein said second engaging pawl is configured to be fitted into said second engagement hole only when said ink tank is in a position to be installed on said tank holder;

wherein said second engaging pawl engages with said second engagement hole of said tank holder in advance, and said ink tank is rotated in a direction of said second engagement hole as the fulcrum to cause said first engaging pawl of said movable lever to engage with said first engagement hole of said tank holder, and wherein said third engaging pawl is for guiding said second engaging pawl of said ink tank to said second engagement hole of said tank holder.

5. An ink tank according to claim 4, wherein said second engaging pawl of the ink tank is in a different position depending on the kind of said ink tank.

6. An ink tank according to claim 4, wherein said second engaging pawl of the ink tank is differently configured depending on the kind of said ink tank.

7. An ink jet head cartridge comprising:

an ink tank to retain ink;

an ink tank holder to hold said ink tank detachably, having a joint connected with an ink supply port of said ink tank, a first hole to engage with a first pawl on a movable lever of said ink tank, and a second hole to engage with a second pawl of said ink tank, said second hole on a side wall face opposite to a side wall face having said first hole; and a recording head unit for discharging the ink supplied from said ink supply port, wherein a distance S between an outer side face of a base portion of the movable lever and a leading end of said second engaging pawl is set to be larger than a distance W between inner wall faces of the side wall having said first engagement hole of said tank holder and the side wall having said engagement hole; and wherein a semicircular rib having a bow-shaped curving face intersecting an insertion direction of said ink tank is arranged on the circumference of said joint of the tank holder for guiding said ink supply port of the ink tank, and a linear rib is arranged to be coupled with said semicircular rib on a side opposite to said joint such that said semicircular rib is between said linear rib and said joint.

8. An ink jet head cartridge comprising:

an ink tank to retain ink;

an ink tank holder to hold said ink tank detachably, having a joint connected with an ink supply port of said ink tank, a first hole to engage with a first pawl of said ink tank, and a second hole to engage with a second pawl of said ink tank, said second hole on a side wall face opposite to a side wall face having said first hole; and a recording head unit for discharging the ink supplied from said ink supply port, wherein a semicircular rib having a bow-shaped curving face intersecting an insertion direction of said ink tank is arranged on the circumference of said joint of the tank holder for guiding said ink supply port of the ink tank, and a linear rib is arranged to be coupled with said semicircular rib on a side opposite to said joint such that said semicircular rib is between said linear rib and said joint.

9. An ink jet head cartridge according to claim 8, wherein the heights of said semicircular rib and said linear rib are made gradually higher toward said joint side, respectively.

10. An ink jet head cartridge according to claim 8, wherein the heights of said semicircular rib and said linear rib are made gradually lower toward said joint side, respectively.

11. An ink jet recording apparatus provided with a carriage having an ink tank to retain ink; a tank holder to hold said ink tank detachably; and a recording head unit for discharging the ink supplied from an ink supply port, said recording head unit being supported to be able to reciprocate along the surface of a recording medium with ink being discharged from said recording head unit to said recording medium for recording in accordance with electric signals for ink discharges, wherein said ink tank holder comprises:

a joint connected with said ink supply port of the ink tank;

a first hole to engage with a first pawl on a movable lever of said ink tank; and a second hole to engage with a second pawl of aid ink tank arranged on a side wall face opposite to a side wall face having said first hole provided thereon, wherein a distance S between an outer side face of a base portion of the movable lever of said ink tank and a leading end of said second engaging pawl is set to be larger than a distance W between inner wall faces of the side wall having said first engagement hole of said tank holder and the side wall having said second engagement hole; and wherein a semicircular rib having a bow-shaped curving face intersecting an insertion direction of said ink tank is arranged on the circumference of said joint of the tank holder for guiding said ink supply port of the ink tank, and a linear rib is arranged to be coupled with said semicircular rib on a side opposite to said joint such that said semicircular rib is between said linear rib and said joint.

12. An ink supply system comprising:

a first ink tank to retain first ink;

a first ink tank holder to install the first ink tank;

a second ink tank to retain second ink;

a second ink tank holder to install the second ink tank, wherein for said first ink tank, a first pawl extrusion is provided to engage with a first engagement portion of said first ink tank holder, and for said second tank a second pawl extrusion is provided to engage with a second engagement hole of said second ink tank holder, and wherein said first pawl extrusion comprises two extrusions arranged in parallel and said first engagement portion comprises two corresponding engagement holes arranged in parallel, and given the width of each of the two extrusions as La, the gap therebetween as Lc, the opening width of each of the two engagement holes as Ma, and the gap therebetween as Mc, and wherein said second pawl extrusion is configured as one elongated side extrusion, and given a width thereof as Le, and the opening width of said second engagement hole for said second pawl extrusion as Me, the relationship between said first pawl extrusion of said first ink tank and said second engagement hole of said second ink tank holder is to satisfy $Lc+2La>Me$ and/or $Lc>Me$ and the relationship between said second pawl extrusion of said second ink tank and said two engagement holes of said first ink tank holder is to satisfy $Le>Ma$ and/or $Le<Mc$.

13. An ink tank used for an ink jet recording apparatus detachably mounting thereon a recording head for discharging ink comprising, a first holder provided with two first engagement holes arranged in parallel to be able to install a first ink tank retaining first ink in a width Ma and a gap Mc, and a second holder provided with a second engagement hole to be able to install a second ink tank retaining second ink in a width Me, wherein two pawl extrusions are arranged for said ink tank in a width La with a gap Lc to satisfy the relationship of $Lc+2La>Me$ and/or $Lc>Me$.

14. An ink tank used for an ink jet recording apparatus detachably mounting thereon a recording head for discharging ink comprising, a first holder provided with two first engagement holes arranged in parallel to be able to install a first ink tank retaining first ink in a width Ma and a gap Mc, and a second holder provided with a second engagement hole to be able to install a second ink tank retaining second ink in a width Me, wherein one pawl extrusion is arranged for said ink tank in a width Le to satisfy the relationship of $Le>Ma$ and/or $Le<Mc$.

* * * * *

UNITED STATES PATENT AND TRADEMARK OFFICE

CERTIFICATE OF CORRECTION

PATENT NO. : 6,390,601 B1
DATED : May 21, 2002
INVENTOR(S) : Osamu Morita et al.

It is certified that error appears in the above-identified patent and that said Letters Patent is hereby corrected as shown below:

Column 2,
Line 9, “absolvent 136” should read -- absorbent 136 --.

Column 3,
Line 29, “tion” should read -- tions --.

Column 5,
Line 36, “holer” should read -- holder --.

Column 6,
Line 27, “illustrate” should read -- illustrates --;
Line 31, “illustrate” should read -- illustrates --;
Line 50, “illustrate” should read -- illustrates --;
Line 54, “illustrate” should read -- illustrates --; and
Line 65, “illustrate” should read -- illustrates --;

Column 7,
Line 1, “illustrate” should read -- illustrates --;
Line 4, “illustrate” should read -- illustrates --;
Line 7, “illustrate” should read -- illustrates --;
Line 25, “invention” should read -- invention. --; and
Line 38, “such” should read -- such as --.

Column 8,
Line 19, “show” should read -- shown --; and
Line 37, “directed” should read -- directly --.

Column 10,
Line 23, “p resent” should read -- present --; and
Line 60, “executable satisfactorily” should read -- satisfactorily executable --.

Column 11,
Line 32, “black” should read -- black ink --;
Line 55, “perspective views which illustrate” should read -- a perspective view which illustrates --;
Line 60, “perspective views” should read -- a perspective view --;
Line 61, “illustrate such” should read -- illustrates such an --; and
Line 65, “an” should read -- a --.

UNITED STATES PATENT AND TRADEMARK OFFICE

CERTIFICATE OF CORRECTION

PATENT NO. : 6,390,601 B1
DATED : May 21, 2002
INVENTOR(S) : Osamu Morita et al.

It is certified that error appears in the above-identified patent and that said Letters Patent is hereby corrected as shown below:

Column 12,
Line 1, “described” should read -- as described --;
Line 25, “holes 50c” should read -- hole 50c --;
Line 41, “as” should read -- as it is --; and
Line 48, “hale” should read -- hole --.

Column 14,
Line 33, “44care” should read -- 44c are --.

Column 15,
Line 34, “44caccordingly.” should read -- 44c accordingly. --;
Line 36, “40yengage” should read -- 40y engage --;
Line 47, “Of” should read -- of --; and
Line 65, “A” should read -- As --.

Column 16,
Line 7, “44care” should read -- 44c are --.

Column 17,
Line 37, “tow” should read -- two --;
Line 48, “black” should read -- black ink --; and
Line 49, “that” should read -- so that --.

Column 19,
Line 60, “aid” should read -- said --.

Column 20,
Line 16, “ink;” should read -- ink; and --;
Line 23, “holder, and” should read -- holder; --;

UNITED STATES PATENT AND TRADEMARK OFFICE

CERTIFICATE OF CORRECTION

PATENT NO. : 6,390,601 B1
DATED : May 21, 2002
INVENTOR(S) : Osamu Morita et al.

It is certified that error appears in the above-identified patent and that said Letters Patent is hereby corrected as shown below:

Column 20 cont'd,
Line 45, "comprising," should read -- comprising --; and
Line 56, "comprising," should read -- comprising --.

Signed and Sealed this

Twentieth Day of August, 2002

*Attest:*

*Attesting Officer*

JAMES E. ROGAN
*Director of the United States Patent and Trademark Office*